US009308629B2

(12) United States Patent
Gadd et al.

(10) Patent No.: US 9,308,629 B2
(45) Date of Patent: Apr. 12, 2016

(54) ADJUSTABLE SOCKET-ENGAGING TOOL SET

(71) Applicants: James David Gadd, Richmond, KY (US); Jonathan David Gadd, Richmond, KY (US)

(72) Inventors: James David Gadd, Richmond, KY (US); Jonathan David Gadd, Richmond, KY (US)

( * ) Notice: Subject to any disclaimer, the term of this patent is extended or adjusted under 35 U.S.C. 154(b) by 254 days.

(21) Appl. No.: 14/169,194

(22) Filed: Jan. 31, 2014

(65) Prior Publication Data

US 2015/0217432 A1 Aug. 6, 2015

(51) Int. Cl.

| | |
|---|---|
| ***B25B 15/00*** | (2006.01) |
| ***B25B 23/00*** | (2006.01) |
| ***B25B 23/16*** | (2006.01) |
| ***B25G 1/08*** | (2006.01) |
| ***B25B 13/10*** | (2006.01) |

(52) U.S. Cl.

CPC ..... *B25B 15/008* (2013.01); *B25B 13/102* (2013.01); *B25B 23/0007* (2013.01); *B25B 23/0042* (2013.01); *B25G 1/085* (2013.01)

(58) Field of Classification Search

CPC ..... B25B 15/008; B25B 23/0042; B25B 23/0007; B25B 13/102; B25G 1/043; B25G 1/085

See application file for complete search history.

(56) References Cited

U.S. PATENT DOCUMENTS 2,465,619 A 3/1949 Veit
2,715,028 A 8/1955 Dossie
2,735,325 A * 2/1956 Rudd, Sr. ..... B25B 13/10 29/436
2,761,342 A * 9/1956 Hall ..... B25B 13/102 7/138
2,822,714 A * 2/1958 Paparelli ..... B25B 13/10 81/185
3,127,798 A * 4/1964 Gol ..... B25B 13/10 279/14
3,298,261 A * 1/1967 Lynn ..... B25B 13/102 81/185
3,349,655 A * 10/1967 Locke ..... B25B 13/105 81/177.5
3,698,267 A * 10/1972 Denney ..... B25B 15/001 269/266
4,307,634 A * 12/1981 Gentry ..... B25G 1/085 81/177.6
4,417,488 A * 11/1983 Gentry ..... B25B 13/06 81/124.4
4,887,498 A * 12/1989 Zayat ..... B25B 13/105 81/185
5,157,995 A * 10/1992 Nogues ..... B25B 13/102 81/124.5
5,287,778 A * 2/1994 Cook ..... B25B 13/105 269/266
5,394,984 A 3/1995 Aiba
5,460,064 A * 10/1995 Zayat, Jr. ..... B25B 13/105 81/185
5,644,959 A * 7/1997 Howard ..... B25B 13/105 81/179

(Continued)

*Primary Examiner* — David B Thomas
(74) *Attorney, Agent, or Firm* — Stockwell & Smedley, PSC

(57) ABSTRACT

The present invention provides a socket-engaging tool set having a plurality of elongated socket-engaging tools assembled together in a concentric arrangement. Each socket-engaging tool may generally have a constant outer cross-sectional size and shape along most or all of its length, and the outer cross-sectional shape may be hexagonal such that the socket-engaging tools are a plurality of concentric hex keys. Biasing springs may be provided to bias the positioning of one or more concentric socket-engaging tool(s) in the absence of an external force that might overcome such biasing. An external force may be used to cause selective retraction/extension of one or more socket-engaging tool(s) to create a common distal end of desired size. A device may include an adjustment mechanism(s) to manually affect the positioning of the one or more socket-engaging tool(s). Methods are also provided for the assembly and operation of a device of the present invention.

20 Claims, 16 Drawing Sheets

(56) References Cited

U.S. PATENT DOCUMENTS

| | | | | | |
|---|---|---|---|---|---|
| 5,806,385 | A * | 9/1998 | Schupp | B25B 13/105 | 81/185 |
| 5,829,328 | A * | 11/1998 | Chen | B25B 13/102 | 81/124.5 |
| 6,023,999 | A * | 2/2000 | Cho | B25B 13/105 | 81/185 |
| 6,092,443 | A * | 7/2000 | Zayat, Jr. | B25B 13/105 | 81/124.5 |
| 6,098,507 | A * | 8/2000 | Lin | B25B 13/105 | 81/185 |
| 6,209,425 | B1 | 4/2001 | Hu | | |
| 6,332,381 | B1 | 12/2001 | Vasudeva | | |
| 6,374,710 | B2 * | 4/2002 | Kuo | B25B 13/105 | 81/185 |
| 6,637,298 | B1 * | 10/2003 | O'Brien | B25B 13/102 | 81/124.5 |
| 6,732,615 | B2 * | 5/2004 | Layaou | B25B 13/102 | 81/124.5 |
| 6,928,906 | B1 * | 8/2005 | Marks | B25B 13/105 | 81/124.5 |
| 7,150,209 | B1 * | 12/2006 | Loomis | B25B 13/102 | 81/124.5 |
| 7,290,469 | B2 * | 11/2007 | Walters | B25B 13/105 | 81/185 |
| 7,413,426 | B2 * | 8/2008 | Kamali | B25B 15/008 | 264/17 |
| 2007/0186731 | A1 | 8/2007 | Schnarr | | |
| 2007/0199413 | A1 * | 8/2007 | Camacho | B25B 13/10 | 81/436 |

* cited by examiner

ADJUSTABLE SOCKET-ENGAGING TOOL SET

BACKGROUND

1. Field of the Invention

The present invention relates to Allen wrench and hex key sets as well as methods of their use with a variety of differently sized hexagonal fastener sockets.

2. Related Art

Hex or Allen keys (sometimes referred to as Allen wrenches) are generally solid elongated tools having a hexagonal cross-sectional shape along its length. These Allen wrenches or hex keys are generally used to turn fasteners having a similarly sized and hexagonally shaped socket or opening. Allen wrenches or hex keys may be L-shaped, such that one end is used to mate with the fastener socket, while the other end away from the socket may be used to facilitate gripping or handling by a user as well as provide leverage for turning. Typically, Allen wrenches or hex keys are in a set of individual wrenches or keys of varying sizes (i.e., having a range of cross-sectional dimensions) for use with fasteners having differently sized sockets.

It can be difficult to keep multiple hex keys of different sizes together since they exist as a set of individual pieces. Although Allen wrenches or hex key sets may be held together by a common holder (even possibly during use), a user must still need to select the correct hex key in the set for a particular use, which may involve removing and/or repositioning the individual hex key from the remainder of the set. However, given the small size differences among various hexagonal fastener sockets and hex keys, it may be difficult to select the best fitting hex key on the first try. Therefore, a user may have to spend time trying out several different hex keys to arrive at the one that best fits the fastener socket effectively. This uncertainty presents a greater issue when a hex key set is not held together by a common holder. In such a case, a user may have to bring several different "candidate" hex keys to determine the correct hex key for a particular fastener, which increases the possibility of dropping or losing individual hex keys.

What is need in the art is an improved hex key set device that holds the individually sized hex keys together and provides an easy way to select the correct hex key size for a particular use without the need for trial-and-error selection by a user. What is also needed in the art is a unified hex key set that is compact and does not require multiple hex keys being separately handled and/or selected for use. What is further needed in the art is a self-selecting or adjustable hex key set that is adaptable for use with a handheld base or holder, as a bit for a power drill, and/or when coupled to a wrench or ratchet.

SUMMARY

According to a first broad aspect of the present invention, a socket-engaging device is provided comprising: a plurality of socket-engaging tools, each of the socket-engaging tools having a proximal end and a distal end, the plurality of socket-engaging tools being assembled together in a concentric arrangement, wherein each of the socket-engaging tools has a constant outer cross-sectional size and shape along most or all of its length, the plurality of socket-engaging tools comprising an outermost socket-engaging tool and one or more inner socket-engaging tools, a holder, the holder having a proximal end and a distal end, wherein the holder at least partially surrounds the plurality of socket-engaging tools, and wherein the outermost socket-engaging tool is fixedly attached to the holder, and at least one biasing spring, the at least one biasing spring being positioned within a cavity inside the holder, wherein the cavity is located between the proximal ends of the socket-engaging tools and a proximal face of the cavity, wherein the one or more inner socket-engaging tools are positioned concentrically within a longitudinal bore of the outermost socket-engaging tool, each of the one or more inner socket-engaging tools being able to move independently along its longitudinal axis relative to the outermost socket-engaging tool, wherein each of the one or more inner socket-engaging tools is biased to a more distal position by the at least one biasing spring, and wherein the distal ends of the plurality of socket-engaging tools project outwardly from the distal end of the holder.

According to a second broad aspect of the present invention, a socket-engaging device comprising: a plurality of socket-engaging tools, each of the socket-engaging tools having a proximal end and a distal end, the plurality of socket-engaging tools being assembled together in a concentric arrangement, wherein each of the socket-engaging tools has a constant outer cross-sectional size and shape along most or all of its length, the plurality of socket-engaging tools comprising an outermost socket-engaging tool and one or more inner socket-engaging tools, the one or more inner socket-engaging tools comprising an innermost first socket-engaging tool; a holder, the holder having a proximal end and a distal end, wherein the holder at least partially surrounds the plurality of socket-engaging tools, and wherein the outermost socket-engaging tool is fixedly attached to the holder, the distal end of the outermost socket-engaging tool projecting outwardly from the distal end of the holder; at least one biasing spring, the at least one biasing spring comprising a first biasing spring, wherein the first biasing spring is positioned within a cavity of the holder between a proximal end piece of the first socket-engaging tool and the proximal end of a next larger socket-engaging tool, the first socket-engaging tool being biased to a more proximal position by the first biasing spring; and a threaded adjusting shaft, the threaded adjusting shaft being engaged with a threaded bore of the holder spanning from the proximal end of the holder to the cavity inside the holder, wherein the threaded adjusting shaft has a distal contacting portion that engages the proximal end piece of the first socket-engaging tool; wherein the one or more inner socket-engaging tools are positioned concentrically within a longitudinal bore of the outermost socket-engaging tool, each of the one or more inner socket-engaging tools being able to move independently along its longitudinal axis relative to the outermost socket-engaging tool, wherein the engagement between the threaded adjusting shaft and the threaded bore of the holder causes proximal or distal movement of the threaded adjusting shaft depending on the direction of rotation of the threaded adjusting shaft relative to the holder, and wherein the proximal biasing of the first socket-engaging tool by the first biasing spring is opposed by the distal contacting portion of the threaded adjusting shaft when the distal contacting portion is engaged with the proximal end piece of the first socket-engaging tool.

According to a third broad aspect of the present invention, a modified socket-engaging tool comprising: a socket-engaging portion, the socket-engaging portion having a constant outer cross-sectional size and shape from a proximal end to a distal end of the socket-engaging portion; a leg portion, the leg portion extending proximally from the socket-engaging portion at or near an outer side edge of the socket-engaging portion; a bumper portion, the bumper portion having a planar shape and extending inwardly from the leg portion at or near the proximal end of the leg portion; and a ledge portion, the ledge portion having a planar shape and extending inwardly from the leg portion, the ledge portion being positioned between the bumper portion and the proximal end of the socket-engaging portion.

According to a fourth broad aspect of the present invention, a socket-engaging device comprising: a plurality of modified hex keys, each of the modified hex keys comprising: a hex key portion, the hex key portion having a constant outer cross-sectional size and shape from a proximal end to a distal end of the hex key portion; a leg portion, the leg portion extending proximally from the hex key portion at or near an outer side edge of the hex key portion; a bumper portion, the bumper portion having a planar shape and extending inwardly from the leg portion at or near the proximal end of the leg portion; and a ledge portion, the ledge portion having a planar shape and extending inwardly from the leg portion, the ledge portion being positioned between the bumper portion and the proximal end of the hex key portion; a main body portion, the main body portion at least partially surrounding the plurality of modified hex keys, the plurality of modified hex keys being positioned within a cavity inside main body portion; and a rotating knob portion, the rotating knob portion being rotatably coupled to the main body portion by a spring loaded coupling that resists retraction of the rotating knob portion away from the main body portion, wherein the plurality of modified hex keys comprises a first modified hex key and a second modified hex key, the hex key portion of the second modified hex key being larger than the hex key portion of the first modified hex key, wherein the second modified hex key has a bore from the proximal end to the distal end of the hex key portion of the second modified hex key, and wherein the hex key portion of the first modified hex key being positioned concentrically within the bore of the hex key portion of the second modified hex key.

According to a fifth broad aspect of the present invention, methods are provided for the assembly and/or operation of a socket-engaging tool of the present invention, or any portion (s) or component(s) thereof, as described herein.

These and other aspects of the present invention will become apparent to those skilled in the art after reading the following description and claims with the accompanying drawings.

BRIEF DESCRIPTION OF THE DRAWINGS

The accompanying drawings, which are incorporated herein and constitute part of this specification, illustrate exemplary embodiments of the invention, and, together with the detailed description herein, serve to explain features of the present invention.

FIG. 3B is a perspective view of the proximal end of a device embodiment of the present invention having a male projecting portion for engagement with a ratchet or the like;

FIG. 3C is a perspective view of the proximal end of a device embodiment of the present invention having a bit for coupling with a power drill or the like;

DETAILED DESCRIPTION

Figure 1A:
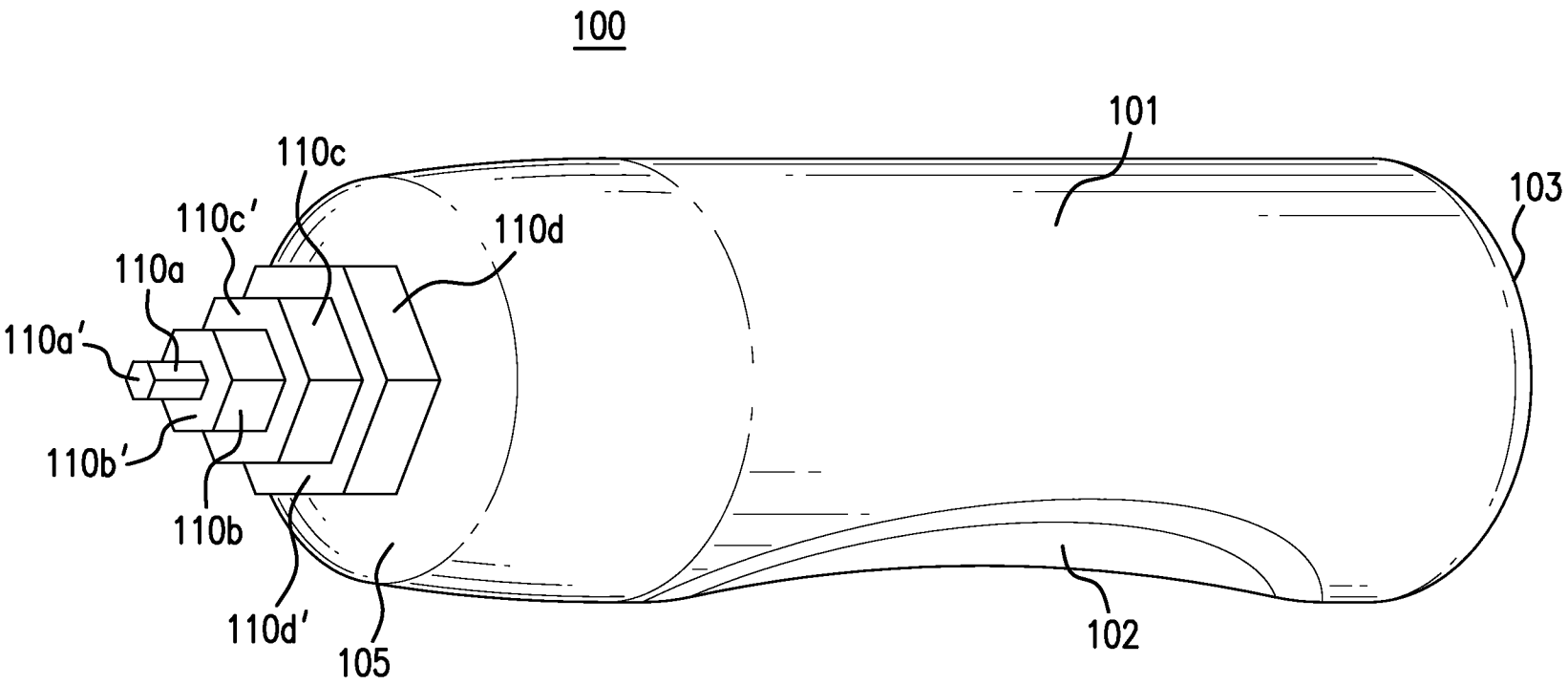
FIG. 1A is a perspective view of a hex key device according to an embodiment of the present invention.

According to a broad aspect of the present invention, a hex key set device is provided having a mechanism that facilitates the selection of an appropriately sized hex key for a particular application or use of the device in causing rotation of a fastener based on the size of the corresponding hexagonal socket of the fastener. Device embodiments of the present invention may generally include a concentric arrangement of elongated hex keys (or Allen wrenches). Each of the hex keys will generally have a hexagonal outer shape in cross-section along most or all of its length. For purposes of the present invention, the term "hexagonal" shall generally refer to the shape of an equilateral hexagon. The outer cross-sectional shape of each hex key will also generally be constant along most or all of its length.

According to other embodiments of the present invention, however, it is also possible that the hex keys may be replaced with other elongated socket-engaging tools or pieces having different cross-sectional shapes (i.e., non-hexagonal cross-sectional shapes). For purposes of the present invention, the term "socket-engaging tool" shall mean an elongated tool having a generally constant outer cross-sectional size and shape along most or all of its length for one of its ends to engage a fastener having a similarly sized and shaped socket, such that rotation of the elongated socket-engaging tool may impart rotation to the fastener when engaged with the socket of the fastener. For purposes of the present invention, the phrase "most or all of its length" shall mean greater than 50% of its total length (i.e., from its proximal end to its distal end), or alternatively greater than 60% of its total length, or greater than 70% of its total length, or greater than 80% of its total length, or greater than 90% of its total length, or greater than 95% of its total length. Although irregular cross-sectional shapes are possible for the individual elongated socket-engaging tools, symmetrical shapes will more typically be used to match the corresponding shape of a fastener socket. Indeed, such non-hexagonal, elongated socket-engaging tools may include elongated polygonal socket-engaging tools, "keys" or pieces having other polygonal or equilaterally polygonal shapes.

It is further possible for an elongated socket-engaging tool(s) (having a generally constant cross-sectional shape along most or all of its length) to also have a socket-engaging portion at or near its distal end that has a different cross-sectional shape. According to these embodiments, the socket-engaging portion would have a cross-sectional shape matching or corresponding to the cross-sectional shape of a socket, but most or all of the remainder of the length of the socket-engaging tool (i.e., proximal to the distal socket-engaging portion) may have a different cross-sectional shape that closely fits inside the bore of the next larger socket-engaging tool. Accordingly, there may be gap(s) between the socket-engaging portion of the socket-engaging tool and a portion of the bore of the next larger socket-engaging tool. However, the cross-sectional shape of the remainder of the socket-engaging tool may be non-circular and/or have additional structures that engage the next larger socket-engaging tool to resist their relative rotation (i.e., to avoid having the small socket-engaging tool simply spin inside the bore of the next larger socket-engaging tool and carry the torque to the fastener). Having this kind of arrangement may facilitate or simply manufacturing of the socket-engaging tools.

According to other embodiments, such non-hexagonal elongated socket-engaging tools may instead have a cross-sectional "star shape" with a cylindrical core and multiple, spaced-apart points or ribs that project radially outward from the cylindrical core. Each of the radially outward projecting points or ribs may generally run (in parallel) along most or all of the length of the respective elongated socket-engaging tool or tool, such that the star-shaped elongated socket-engaging tool has a constant cross-sectional shape along most or all of its length. The number of such radially outward projecting points, ribs, etc., of such a star-shaped elongated socket-engaging tool of the present invention may include two or more, three or more, etc., such as three, four, five, six, seven, eight, none, ten, eleven, twelve, etc., of such parallel points, ribs, etc. For example, embodiments of the present invention may include a plurality of concentric TORX wrenches having any number of spaced-apart points, ribs, etc., such as six points, ribs, etc. Sizes for the concentric TORX wrenches according to these embodiments of the present invention may vary and may each be any size within the known T1-T100 range of sizes.

According to embodiments of the present invention, each of the concentrically arranged socket-engaging tools or hex keys of the device (except for the innermost socket-engaging tool or hex key) will also generally have a longitudinal bore or hole through it to accommodate a smaller socket-engaging tool(s) or hex key(s) positioned or inserted inside the bore. For the next smaller socket-engaging tool or hex key to closely fit inside the bore of a larger hex key, the inner cross-sectional shape of the bore will also have a similar cross-sectional shape (e.g. a hexagonal shape) and be about the same size as (or slightly larger than) the outer cross-sectional size and shape of the next smaller socket-engaging tool or hex key. With the bore(s) and outer cross-sectional shape(s) of the contiguous socket-engaging tools or hex keys being non-circular (e.g., hexagonal) and similarly sized for a close fit together, each of the concentric socket-engaging tool(s) or hex key(s) will generally be unable to rotate around its longitudinal axis when inserted into the bore of the next larger socket-engaging tool or hex key. The plurality of concentric socket-engaging tools or hex keys of the present invention may be further contained inside a holder, base, handle, etc., which may comprise one or more parts that may be assembled together around the concentric socket-engaging tools or hex keys.

For purposes of the present invention, the relative terms "larger" and "smaller" in reference to the size of socket-engaging tools or hex keys shall refer to their relative cross-sectional size and dimensions. The terms "next larger" and "next smaller" shall mean a socket-engaging tool or hex key having the next larger or next smaller size, respectively. In other words, a socket-engaging tool or hex key would fit most closely inside the bore of a "next larger" socket-engaging tool or hex key (i.e., the outer cross-sectional sides of the socket-engaging tool or hex key would be closest to, and juxtaposed with, the inner walls or sides of the bore of the "next larger" socket-engaging tool or hex key when inserted into the next larger socket-engaging tool or hex key). Conversely, the bore of a socket-engaging tool or hex key would most closely surround the outer cross-sectional sides of a "next smaller" socket-engaging tool or hex key.

By relative sliding movement in the proximal or distal direction of one or more of the smaller concentric socket-engaging tool(s) or hex key(s) inside the longitudinal bore(s) of a larger socket-engaging tool(s) or hex key(s), the total cross-sectional size of the most distally projecting end(s) of the concentric socket-engaging tool(s) or hex key(s) (i.e., the common distal end of the most distally extended socket-engaging tool(s) or hex key(s)) may be adjusted to closely fit a socket of a fastener. For example, additional hex key(s) may be slid or moved distally (from a more retracted position)

such that their distal end(s) join with (i.e., become approximately even and flush with) the distal end of the innermost hex key. This process may generally operate sequentially such that only two, three, four, etc., contiguous socket-engaging tools or hex keys are extended distally to form a common distal end of progressively larger size with the innermost socket-engaging tool or hex key. Alternatively, the innermost socket-engaging tool or hex key may be retracted proximally (from a more extended position), such that its distal end becomes approximately even and flush with the distal end of the next larger socket-engaging tool or hex key, at which point the two innermost socket-engaging tools or hex keys may be retracted proximally such that their distal ends become approximately even and flush with the next larger socket-engaging tool or hex key, and so on, such that a common distal end of progressively larger size is formed.

According to yet another set of embodiments, one or more contiguous hex keys or socket-engaging tools may be extended distally together (from a more retracted position) such that they create a common distal end of a desired size. For purposes of the present invention, the term "contiguous" shall refer to a series of two or more adjacent hex keys or socket-engaging tools that are not separated by other hex keys or socket-engaging tools (i.e., an uninterrupted series of next larger or next smaller hex keys). To promote a smoother sliding movement relatively between and among the concentric hex keys or socket-engaging tools, a lubricating material, such as graphite, oil, etc., may be present between adjacent or contiguous hex keys and inside the bores of the hex keys to lessen or minimize the amount of friction.

each of the longitudinal bores of the hex keys or socket-engaging tools will generally have a constant hexagonal cross-sectional shape along most or all of its length, which is about the same size as, or slightly larger than, the outer cross-sectional size and shape of the next smaller hex key or socket-engaging tool positioned and inserted inside the bore. Such a constant cross-sectional shape of a hex key or socket-engaging tool (along with the constant and similar cross-sectional shape of the bore of the next larger hex key or socket-engaging tool) will generally allow for those two hex keys or socket-engaging tools to slide or move in relation to each other in either of the two directions along their longitudinal axes, the longitudinal axes of the two hex keys or socket-engaging tools and the bore being generally in parallel with each other (other than slight deviations that may be possible). In other words, each hex key or socket-engaging tool of a plurality of concentric hex keys or socket-engaging tools may slidably move in relation to one or more of the other hex key(s) or socket-engaging tool(s), and multiple hex keys or socket-engaging tools may slidably move together at the same time. However, the largest of the hex keys or socket-engaging tools will not be present inside the bore of another hex key or socket-engaging tool. The largest hex key or socket-engaging tool may instead be directly or indirectly attached and/or fixed to a holder, base, handle, etc., that at least partially contains the hex key or socket-engaging tool set. Thus, the largest hex key or socket-engaging tool of a concentric hex key or socket-engaging tool device of the present invention may not move in relation to such an outer holder, base, handle, etc., but the smaller hex key(s) or socket-engaging tool(s) positioned inside the longitudinal bore of the largest hex key or socket-engaging tool may be able to slide or move relative to the largest hex key or socket-engaging tool in either or both directions along their longitudinal axes.

Any reasonable number of concentric hex keys or socket-engaging tools may be present in a device of the present invention, which may or may not be present within a holder, base, handle, etc. The example embodiments depicted in the figures depict a relatively simple handle or base having a generally cylindrical shape. However, based on the description herein, a skilled artisan would recognize that a holder, handle, base, etc., of a device of the present invention (enclosing the cavity and/or at least partially housing the plurality of concentric hex keys or socket-engaging tools) may have a variety of different sizes, configurations, shapes, etc., and/or may comprise additional structures or features, while maintaining the basic conceptual feature(s) of the present invention. Although the example device embodiments of the present invention as shown in the figures include four concentric hex keys, the concepts and principles of the present invention depicted in these figures would also be applicable to a greater or lesser number of concentric hex keys or socket-engaging tools. For example, a device of the present invention may include any number of concentric hex keys or socket-engaging tools, such as in a range from two (2) to fifteen (15) concentric hex keys or socket-engaging tools, or alternatively in a range from two (2) to ten (10) concentric hex keys or socket-engaging tools, or alternatively in a range from two (2) to eight (8) concentric hex keys or socket-engaging tools, or six (6) concentric hex keys or socket-engaging tools.

According to device embodiments of the present invention comprising a plurality of concentric hex keys, the outer cross-sectional sizes of the hex keys at least near their distal ends may include any collection of commonly sized hex keys. Such hex key sizes may include any hex key size (measured between opposing hex key faces) in a range from about 1/40 inch to about 2 inches, or within any other range of sizes therein. Alternatively, such hex key sizes may include any hex key size in a range from about 0.7 mm to about 46 mm, or within any other range of sizes therein. The concentric hex key set of the present invention may include a plurality of hex key sizes that increase by regular or variable intervals or increments. Such hex key sizes may include commonly sized hex keys (in reference to the size of the corresponding socket of a fastener), such as about 1/16, 5/64, 3/32, 7/64, 1/8, 9/64, 5/32, 3/16, 7/32, 1/4, 5/16, 3/8, 7/16, 1/2, 9/16, 5/8, 3/4, 7/8, 1, 1 1/4, or 1 1/2 inch(es). On the metric scale, such commonly sized hex keys (in reference to the size of the corresponding socket of a fastener) may include those that are about 0.7, 0.9, 1.0, 1.25, 1.3, 1.5, 2.0, 2.5, 3, 3.5, 4, 4.5, 5.0, 5.5, 6, 7, 8, 9, 10, 11, 12, 13, 14, 15, 16, 17, 18, 19, 20, 21, 22, 24, 25, 27, 30, 32 or 36 mm.

According to many embodiments, some kind of holder, etc., may need to be included as part of a device of the present invention to provide one or more internal cavities that interact with a biasing mechanism(s) that longitudinally predisposes each of the hex keys or socket-engaging tools of the device to a respective default position (e.g., fully extended or retracted). According to many embodiments of the present invention, such a biasing mechanism may be overcome by application of an external force to achieve a different positioning of one or more of the concentric hex keys or socket-engaging tools. For example, an external force may be created by the distal end(s) of one or more of the hex key(s) or socket-engaging tool(s) encountering and being pressed against and/or into a socket of a fastener. As another example, an external force may instead be applied directly or indirectly to a proximal end(s) of one or more of the hex key(s) or socket-engaging tool(s) by a contacting surface of an adjusting mechanism of the device that can be moved distally for extension or proximally for retraction.

Many of the example embodiments described herein use a spring to bias the movement and positioning of the socket-engaging tool(s) (or hex key(s)) and/or other structural features of the present devices in a particular way. However, any such biasing mechanism(s) may instead be another type of non-spring biasing mechanism(s) known in the art that may be incorporated into a device to cause the movement and positioning of a respective component of a device of the present invention, such as a socket-engaging tool, etc., to be biased in one direction or to a particular position. Even if springs are used to bias the movement or positioning of a particular device component, a plurality of smaller spaced-apart springs may be used in place of a single larger spring, with the plurality of smaller spaced-apart springs occupying the space that would otherwise be occupied by the coil of the single larger spring.

While the present invention relates to an adjustable socket-engaging device comprising a plurality of elongated socket-engaging tools that are concentrically arranged relative to each other, the remainder of the description below will refer to devices having a plurality of hexagonal or hex keys. However, one skilled in the art would understand based on the description provided herein that the inventive concepts of the present invention described in relation to a plurality of concentric hex keys could also be applied to a plurality of concentric socket-engaging tools having other cross-sectional shapes and dimensions, such as other polygonal shapes or star shapes, that are also concentrically arranged and able to independently move or slide relative to each other. Thus, even though the description below is directed to a plurality of hex keys, such description is also intended to similarly cover a plurality of socket-engaging tools having other cross-sectional shapes and dimensions.

FIG. 1A provides a perspective view of a device embodiment 100 of the present invention. The device 100 is shown including a handle or base 101 having a proximal end 103 and a distal end 105 and an optional cut-away portion 102 that may provide styling or gripping of the handle or base 101 by the hand of a user. A plurality of concentrically arranged hex keys 110*a-d* are further shown (ranging from the innermost hex key 110*a* to an outermost hex key 110*d*) that each project outward from the distal end 105 of the device 100 (see also FIG. 1B). Starting from their positioning in FIGS. 1A and 1C, the concentric hex keys 110*a-c* of the device 100 may retract individually and sequentially to accommodate a hexagonal socket of a fastener by a common distal end (of progressively larger size) being formed by the distal ends 110' of two or more hex keys of the device becoming approximately even, flush and parallel with each other. Such retraction may be achieved by overcoming the force(s) of an internal biasing mechanism(s) or spring(s) that causes the hex key(s) to default to a more extended position.

According to the embodiment in FIG. 1, a user holding the device 100 may first place the distal end 110*a*' of the first, smallest and innermost hex key 110*a* into the hexagonal socket of a fastener. If the portion of the first hex key 110*a* at or near its distal end 110*a*' fits closely or snugly inside the hexagonal socket (i.e., the outer dimensions of the first hex key 110*a* at or near its distal end 110*a*' are about the same as, or slightly less than, the inner dimensions of the socket), then the user may proceed to turn the device 100 to cause rotation of the fastener. If, however, the first hex key 110*a* is too small to fit closely inside the socket and impart rotation to the fastener, then the user may continue to press the distal end 110*a*' of the first hex key 110*a* against the fastener to cause the first hex key 110*a* to retract into the device 100 (i.e., by overcoming a biasing mechanism or spring inside the device 100). As a result, the distal end 110*a*' of the first hex key 110*a* eventually becomes approximately even and flush with the distal end 110*b*' of the second and next larger hex key 110*b*, and the distal ends 110*a*', 110*b*' of the first and second hex keys 110*a*, 110*b* together form a common distal end. If the common distal end of the hex keys 110*a*, 110*b* closely fits in the hexagonal socket (i.e., the outer dimensions of the second hex key 110*b* are about the same as, or slightly less than, the inner dimensions of the socket), then the user may proceed to turn the device 100 to cause rotation of the fastener. If, however, the portion of the second hex key 110*b* at or near its distal end 110*b*' is too small to fit closely inside the socket and impart rotation to the fastener, then the user may continue to press the distal ends 110*a*', 110*b*' of the first and second hex keys 110*a*, 110*b* against the fastener to cause the first and second hex keys 110*a*, 110*b* to retract into the device 100 (i.e., by overcoming biasing mechanisms or springs inside the device 100).

This process may be repeated with further retraction of the third and next larger hex key 110*c*, to cause the distal end 110*c*' of the third hex key 110*c* to become approximately even and flush with the distal ends 110*a*', 110*b*' of the first and second hex keys 110*a*, 110*b*, such that the common distal ends 110' may become progressively larger to fit the socket of the fastener. Although not shown in FIG. 1, if additional concentric hex key(s) larger than the third hex key are present that are also slidably movable, then the above process could be repeated accordingly to fit progressively larger sockets. To allow for individual engagement between the progressively larger hex key(s) and the fastener socket, the distal end(s) of the hex key(s) must extend outward a sufficiently greater distance than the next smaller hex key when those hex keys are fully extended such that it may individually engage the socket of a fastener. Such a distance between the respective planes of the distal ends of two adjacent and contiguous hex keys may depend on the depth of a fastener socket (i.e., be about the same or greater than the fastener socket depth). For example, such a distance between the respective planes of the distal ends of two adjacent and contiguous hex keys may be in a range greater than about 1/32 inch but less than about 1/2 inch, or any distance therein, such as about 1/16, 1/8, 3/8, or 1/4 inch.

For purposes of the present invention, the phrase "approximately even and flush" with regard to the distal ends of two or more hex keys shall mean that those hex keys are positioned along their longitudinal axes such that the respective planes occupied by their distal ends are approximately co-planar (i.e., within the same plane or only slightly spaced-apart). For example, any such slight spacing between the approximately even and flush planes of the respective distal ends of the hex keys may tolerably be less than about 1/16 inch. During the process of retracting One or more hex key(s), the hex key(s) may also need to be rotated on their longitudinal axis until the outer hexagonal shape of a hex key becomes aligned with the hexagonal socket of a fastener, such that the hex key(s) may be inserted into the socket. This "searching for alignment" by manual rotation of the hex keys may be done simultaneously while the hex key(s) are being pressed against and/or into the fastener. However, such a rotation of the hex key(s) must be done by rotating the hex key(s) and/or device as a whole since the individual hex keys would not be able to rotate relative to each other.

Figure 1B:
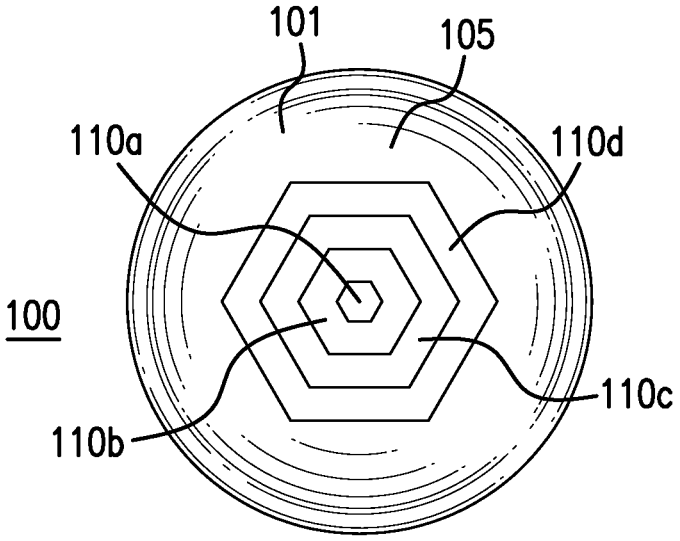
FIG. 1B is a view of the distal side of the hex key device embodiment in FIG. 1A.
Figure 1C:
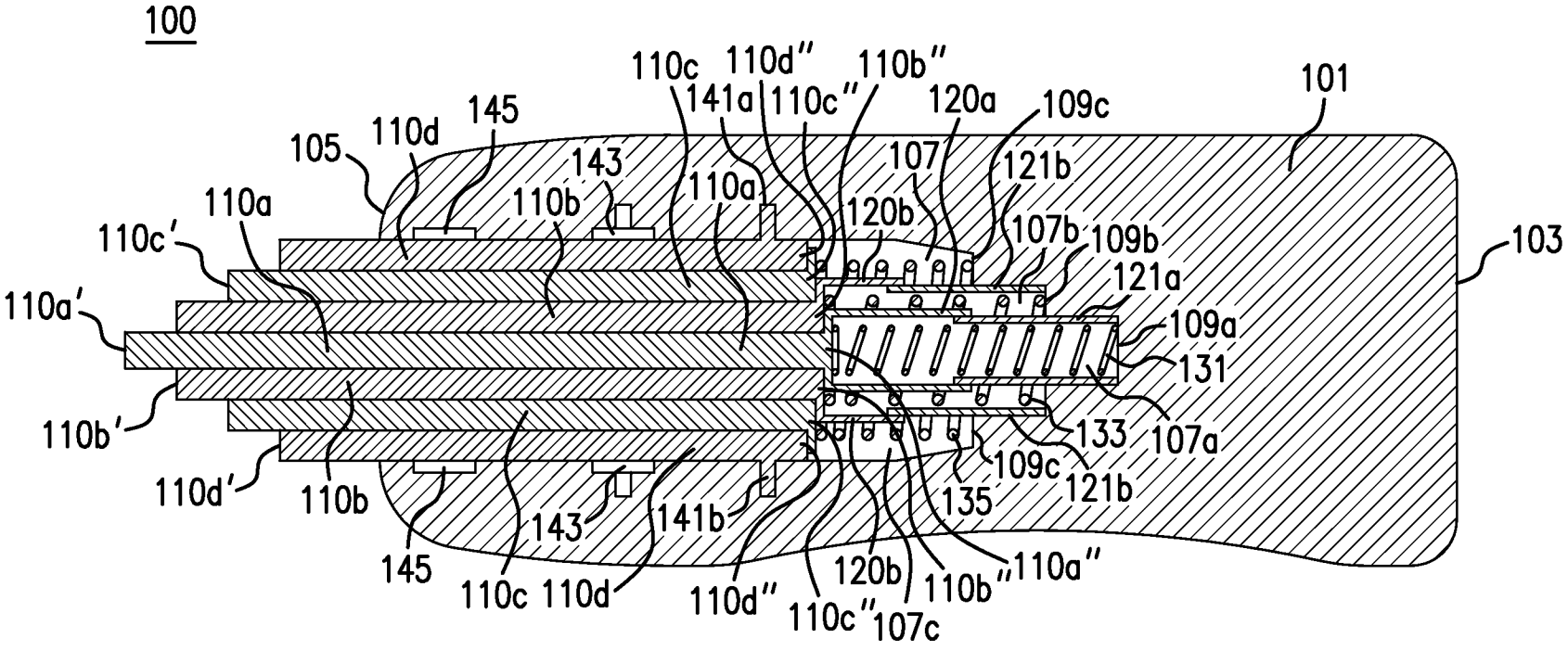
FIG. 1C is a cross-sectional view of the device embodiment in FIGS. 1A and 1B with the hex keys extended.

FIG. 1C shows a cross-sectional view of the device 100 in FIGS. 1A and 1B. The concentric arrangement of the hex keys 110*a-d* described above can be seen internally in this figure. In addition to their distal ends 110', each of the hex keys 110 also has a respective proximal end 110" at the opposite end of the hex key 110. (Although the lines for the reference numbers in the figure used to label the proximal ends 110" of the hex keys 110 are shown extending slightly into the interior of the respective hex key, this is done for improved visualization.

However, these reference numbers are meant to represent the proximal ends 110" of hex keys opposite their distal ends.)

Each of the hex keys 110 in FIG. 1C is shown biased to a fully extended position in FIG. 1C due to forces created by biasing springs 131, 133, 135. These biasing springs may typically be metal helical coils. In the default position of the device 100 in FIG. 1C, the distal end 110*a*' of the smallest first hex key 110*a* is caused to be extended the farthest distance distally by the first innermost spring 131 due to the first hex key 110*a* having the greatest length, the distal end 110*b*' of the second hex key 110*b* is caused to be extended distally by the second spring 133 the second farthest distance due to the second hex key 110*b* having a length that is less than the length of the first hex key 110*a*, the distal end 110*c*' of the third hex key 110*c* is also caused to be extended distally by the third spring 135 the third farthest distance due to the third hex key 110*c* having a length that is less than the length of the second hex key 110*b*, and the distal end 110*d*' of the fourth hex key 110*d* is fixed in position due to the direct or indirect attachment, connection, etc., of the fourth hex key 110*d* to the base or handle 101. The distal end 110*d*' is positioned the least distance distally due to the fourth hex key 110*d* having the smallest length that is less than the length of the third hex key 110*c*.

A variety of structure(s), projection(s), etc., may be present to attach, connect, etc., the outermost hex key (e.g., the fourth hex key 110*d* in FIG. 1) to the base or handle of a device of the present invention. For example, projections 141*a*, 141*b* are shown that are continuous with the outermost and fourth hex key 110*d*. These spaced-apart projections 141*a*, 141*b* (perhaps in addition to other projection(s) around the periphery of the outermost hex key 110*d*) may help to hold the fourth hex key 110*d* in place inside the base or handle 101 (i.e., to keep the fourth hex key 110*d* from falling out of the base or handle 101) by their contact and engagement with corresponding slots, openings, etc., in the base or handle 101. Alternatively, an annular ring, or portions thereof, may be present instead of a plurality of spaced-apart projections around the periphery of the outermost hex key. Although the projection(s) 141 are shown having a simple block shape and located nearer to the proximal ends 110" of the hex keys 110, a variety of different shapes, placements, arrangements, spacings, etc., are also possible. Indeed, multiple projections may be present at and/or around the periphery of the outermost hex key at different locations along its length. Other bands or structures 143, 145 may be present around the periphery of the outermost hex key 110*d*, which may not be continuous with the outermost hex key 110*d*. These bands or structures may also help to guide and/or secure the hex keys 110 inside the base or holder 101. An enveloping structure(s) that does not participate in engagement with any fastener, which may not project out the distal end of the base or handle and/or may even resemble an outermost hex key, may be present that surrounds the outermost hex key to indirectly attach, etc., the concentric hex keys (particularly the outermost hex key more directly) to the base or handle (not shown). As a result of the outermost hex key (e.g., fourth hex key 110*d* in FIG. 1C) being held in place by some type of engagement with the surrounding base or handle of the device, the other hex keys may be further held in place by direct or indirect contact and engagement with the outermost hex key.

A device of the present invention may reach a default equilibrium state when no external force is applied by a stopping mechanism(s) to counteract and oppose the biasing mechanism(s) that may otherwise cause the hex keys to become more extended or retracted relative to the base or handle of the device. As a result the hex keys would move distally until such a stopping mechanism(s) stops any further distal movement of the associated hex key(s). Thus, the hex key(s) would assume a default (extended) position that is static in the absence of an external due to the opposing forces of the biasing spring(s) and the stopping mechanism(s). For example, one or more radially outward ledge(s) or side projection(s) may be present on the side(s) of the hex key(s) that interact with an opposing structure of the next larger hex key to stop any further distal movement of the hex key in response to the distally biasing force(s) of the spring(s). Although the ledge(s) may conceivably be present at different position(s) along the length of the respective hex key, the ledge(s) may preferably be present at or near the proximal end of the respective hex key. As shown in FIG. 1, for example, the inner hex keys 110*a-c* inside the outermost and fourth hex key 110*d* may be held inside the base or handle 101 of the device 100 by their concentric placement inside the bore of the largest hex key 110*d* and by a respective radially outward extending ledge(s) at or near the proximal ends 110" of the smaller hex keys 110*a-c*. Each of these radially outward extending ledge(s) eventually contacts the proximal end 110" of the next larger hex key 110 to keep each of these smaller hex keys 110*a-c* from falling out the distal ends of the bores of the larger hex key(s) 110. These radially extending ledge(s) at the proximal end 110" of each hex key 110 of the device 100 in FIG. 1 may include a plurality of spaced-apart ledges or an annular ledge or ring, or portions thereof, at and around the periphery of the proximal end 110" of the respective hex key 110.

Thus, if the first spring 131 is unopposed by an external force, the distal face of the radially outward extending ledge(s) at the proximal end 110*a*" of the innermost and first hex key 110*a* contacts the proximal face of the proximal end 110*b*" of the next larger and second hex key 110*b*. If the second spring 133 is unopposed by an external force, the distal face of the radially outward extending ledge(s) at the proximal end 110*b*" of the second hex key 110*b* contacts the proximal face of the proximal end 110*c*" of the next larger and third hex key 110*c*. Finally, if the third spring 135 is unopposed by an external force, the distal face of the radially outward extending ledge(s) at the proximal end 110*c*" of the third hex key 110*c* contacts the proximal face of the proximal end 110*d*" of the next larger and fourth hex key 110*d*.

According to the device embodiment 100 in FIG. 1, the retraction or extension of the hex keys 110 may be individually caused or controlled. Because each of the inner hex keys 110*a-c* has its own dedicated biasing spring 131, 133, or 135 housed in a cavity 107 inside the base or handle 101 of the device 100, the inner hex keys 110*a-c* may be individually retracted or extended by application or removal of an external force(s). In the default state described above (i.e., without application of an external force), each of the inner hex keys 110*a-c* is fully extended by their respective springs 131, 133, 135, and the portions of the hex keys 110*a-d* near their distal ends 110*a-d*' have a stepped, pyramid-like arrangement (e.g., separated by the distances described above). From this default position, the springs 131, 133, and 135 may be individually and sequentially compressed by application of an external force(s) to the distal end(s) 110' of the hex keys 110 to cause the respective hex key(s) 110 to become retracted proximally into the respective bore(s) and handle or base 101. As further shown in FIG. 1C, the springs 131, 133, 135 are present concentrically within a space or cavity 107 inside the handle or base 101 of the device 100.

With the device embodiment 100 in FIG. 1, the distal end 110*a*' of the first hex key 110*a* would generally be the first of the concentric hex keys 110 to encounter and contact an opposing surface (e.g., inside the socket of a fastener) since it is the most distally extended hex key 110 in the default state. If the innermost and first hex key 110*a* closely fits the socket, then the device 100 may be turned to cause rotation of the fastener. If however, the first hex key 110*a* does not fit the socket (i.e., it is too small), then the device 100 may be pressed further into the socket in the distal direction to cause the first hex key 110*a* to become retracted into the bore of the second hex key 110*b* and handle/base 101 by compressing the first biasing spring 131. The first spring 131 is shown present between the proximal end 110*a*" of the first hex key 110*a* and a first proximal surface or face 109*a* of the innermost portion 109*a* of the cavity 107.

Figure 1D:
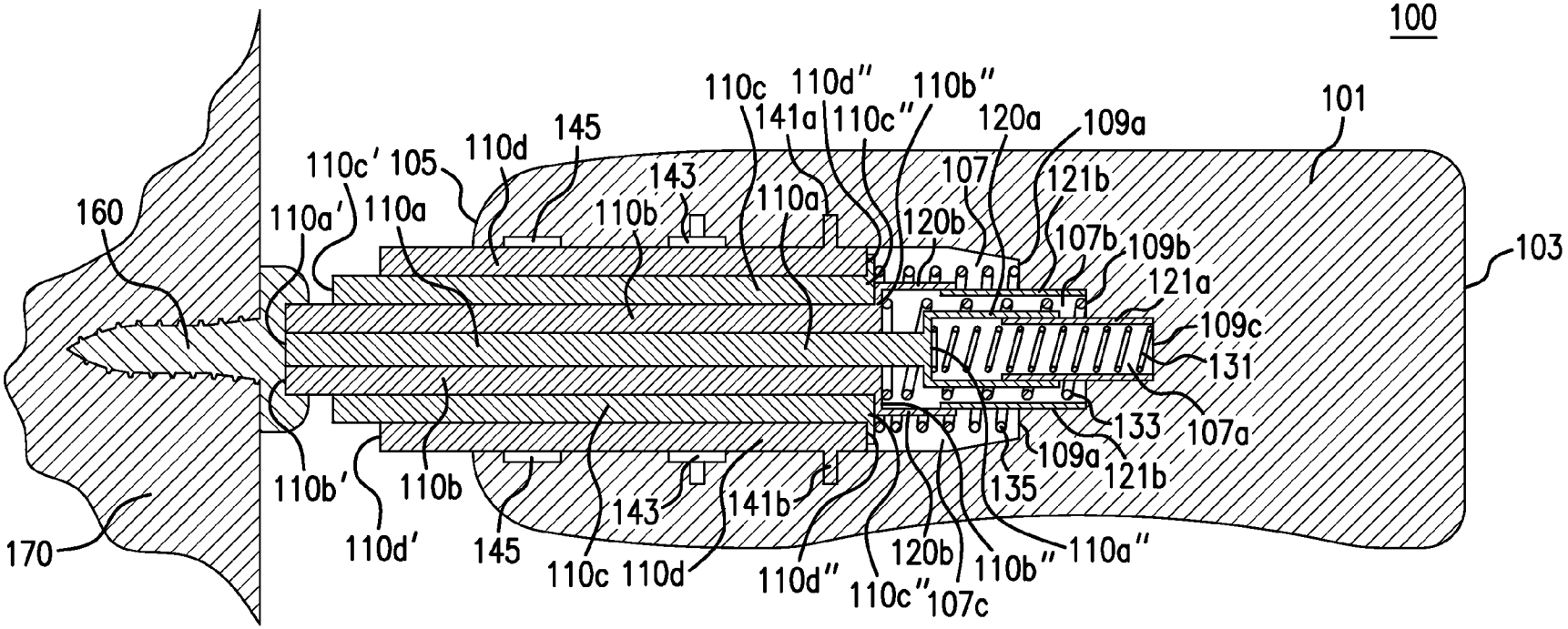
FIG. 1D is a cross-sectional view of the device embodiment in FIG. 1C with the innermost hex key retracted to accommodate the socket of a fastener.

FIG. 1D shows the device embodiment 100 of FIG. 1C but with the innermost and first hex key 110*a* retracted to accommodate the socket of a fastener 160. As shown in FIG. 1D, the first spring 131 of the device 100 becomes compressed (against its tendency or biasing to be more extended) when an external force causes the first hex key 110*a* to slide or move proximally whereupon the distance between the proximal end 110*a*" of the first hex key 110*a* and the proximal face 109*a* of the first cavity portion 107*a* is shortened and a spacing is formed between the ledge(s) at or near the proximal end 110*a*" of the first hex key 110*a* and the proximal end 110*b*" of the second hex key 110*b*. Thus, the first spring 131 is compressed due to the shortened cavity distance. As shown in FIG. 1D, the external force may be the push back or counteraction by a less movable interior surface of the socket of a fastener 160, such as a screw or the like, as the distal end(s) of the hex key(s) 110 of the device 100 is/are pressed into and against the fastener 160. The fastener 160 may be relatively less movable due to its contact, insertion, interaction, etc., with another solid substrate or material 170.

As shown in FIG. 1D, the first hex key 110*a* may become retracted until its distal end 110*a*' becomes approximately even and flush with the distal end 110*b*' of the next larger and second hex key 110*b*. With the example in FIG. 1D, retraction of the first hex key 110*a* is enough for the combined size of the first and second hex keys 110*a*, 110*b* (i.e., their common distal end) to closely fit inside the socket of the fastener 160. Although not shown in FIG. 1D, if the common distal end formed by the combination of the distal ends 110*a*', 110*b*' of the first and second hex keys 110*a*, 110*b* was not large enough to closely fit inside the socket of a fastener, then the process could continue with the further combined retraction of the first and second hex keys 110*a*, 110*b* together (i.e., by the user pressing the device 100 further into the fastener socket) until the distal ends 110*a*', 110*b*' become approximately even and flush with the distal end 110*c*' of the third hex key 110*c*, and so on.

As a result of the second hex key 110*b* becoming retracted (and the first hex key 110*a* becoming even further retracted) by the counteractive force of the relatively immovable fastener against the distal ends 110*a*', 110*b*' of the first and second hex keys 110*a*, 110*b*, a larger common distal end is formed by the distal ends 110*a*', 110*b*', 110*c*' of the first, second and third hex keys 110*a*, 110*b*, 110*c* becoming approximately even and flush with each other. The retraction of the second hex key 110*b* causes the second biasing spring 133 to become compressed (i.e., against its tendency or biasing to be more extended) due to the proximal sliding movement of the second hex key 110*b*, which would cause the second spring 133 housed in cavity 107 to become compressed by shortening the distance between the proximal end 110*b*" of the second hex key 110*b* and the proximal face 109*b* of the second cavity portion 107*b*. Due to the first hex key 110*a* being further retracted along with the second hex key 110*b*, the first spring 131 would simultaneously become further compressed due to the further shortening of the distance between the proximal end 110*a*" of the first hex key 110*a* and the proximal face 109*a* of the first cavity portion 107*a*.

This process could continue sequentially (depending on the number of hex keys 110) until the common distal end of the hex keys 110 is sufficiently large to accommodate the socket size of the fastener. For example, an analogous process could also describe how the distal ends 110*a*', 110*b*', 110*c*' of the first, second and third hex keys 110*a*, 110*b*, 110*c* may become approximately even and flush with the distal end 110*d*" of the fourth hex key 110*d* to accommodate the size of a fastener socket by yet further retraction of the first, second and third hex keys 110*a*, 110*b*, 110*c* and compression of their respective biasing springs. Such a process would also involve a third spring 135 being compressed by the proximal sliding movement of the third hex key 110*c* that shortens the distance between the proximal end 110*c*" of the third hex key 110*c* and the proximal face 109*c* of the third cavity portion 107*c*.

With one or more of the first, second and third springs 131, 133, 135 being compressed by proximal sliding movement of one or more of the first, second and third hex keys 110*a*, 110*b*, 110*c*, a negative tension would exist in the compressed spring(s) that would be counteracted by the external opposing force (e.g., pressing of the device against a fastener). Thus, once the external force is removed (e.g., by disengaging contact with the fastener), the negative tension in the spring(s) 131, 133, and/or 135 will cause them to become re-extended (due to the absence of the external counteracting force), which would also cause the retracted hex key(s) 110 to slidably move in the distal direction to their default (most distally extending) position. As described above, distal movement of the hex key(s) 110 (i.e., by re-extension of the compressed spring(s) to relieve their negative tension) will eventually become stopped by the ledge(s) at or near the proximal end(s) 110" of the respective hex key(s) 110 each contacting an opposing surface or face of the proximal end 110" of the next larger hex key 110.

To accommodate a plurality of biasing springs inside the base or holder of a device embodiment of the present invention, which are each individually dedicated to one of the concentric hex keys, a cavity is provided inside the device on the proximal sides of the concentric hex keys to house these individually dedicated springs. The cavity may have a variety of different cross-sectional shapes although a concentric shape may be most common to accommodate the typically cylindrical shape(s) of the spring(s). According to some embodiments, each of the springs may contact a common planar proximal face of the cavity. According to other embodiments, however, the cavity may instead comprise two or more cavity portions each having their own proximal face (see, e.g., FIGS. 1, 2 and 4), and each of the individual springs may be positioned at least partially within one of these cavity portions, which may or may not be shared with one or more of the other spring(s). For example, each of the cavity portions may be occupied by only one of the springs, which may help to keep the respective springs properly aligned while avoiding their interference with each other.

According to some embodiments, such cavity portions may have a stepped structure with the proximal face of the cavity portions becoming progressively more proximally positioned in the radially inward direction (i.e., stepped more proximally in the radially inward direction), such that the smallest cavity portion in cross-sectional shape is the most proximal cavity portion. Each of these cavity portions may also be continuous with a common distal portion of the cavity. Such a proximally stepped arrangement of the cavity portions may also provide progressively more room to accommodate the potentially greater range of proximal sliding movement of the inner hex keys during their retraction from a fully extended state.

According to some embodiments of the present invention, additional guide tube(s) or wall(s) may be optionally present inside the cavity of the device to contain one or more of the concentrically arranged biasing springs and keep them from becoming misaligned and/or interfering or binding with another spring. Such guide tube(s) may include a pair of guide tubes per spring including a distal guide tube and a proximal guide tube, or they may include one guide tube per spring that fits into a corresponding cavity portion of the device that also at least partially houses the spring contained in the guide tube. The distal guide tube 120 may be directly or indirectly connected, attached, continuous with, etc., the proximal end 110" of the respective hex key 110, and the proximal guide tube 121 may be directly or indirectly connected, attached, etc., to the side(s), edge(s) and/or surface(s) of the cavity of the device and/or a corresponding cavity portion. Each of the proximal and distal guide tubes may be fixed in relation to the device cavity or the corresponding hex key, respectively, to which they are each directly or indirectly connected, attached, etc. The proximal guide tube may function to "extend" a corresponding cavity portion for mating with its distal guide tube. If present, each guide tube may be solid and provide a full enclosure, or it may have a "broken" construction with one or more slots, openings, etc., as long as it is sufficient to contain the corresponding spring inside of it.

According to the example embodiment in FIG. 1, a pair of guide tubes surrounding each of the first and second springs 131, 133 is shown with each pair of guide tubes including a proximal guide tube 121 and a distal guide tube 120 that may be slidably engaged with each other (i.e., with one inserted inside the other), such that proximal or distal sliding movement of a respective hex key 110 can be accommodated by the pair of guide tubes. A gap or spacing may also exist in a default state between the proximal end of the distal guide tube 120 and a corresponding proximal surface 109 of the cavity 107 to allow for the retraction of the respective hex key 110 and the proximal movement of the distal guide tube 120. For example, a proximal guide tube 121*a* may slidably engage (i.e., become inserted into) a distal guide tube 120*a*, or vice versa, to contain the first spring 131 during movement and separate it from the second spring 133 while the proximal and distal guide tubes 120*a*, 121*a* slide relative to each other.

According to other embodiments, a device of the present invention may instead have cavity portions that are more separated from each other and/or individually dedicated to each of the springs. FIG. 2 provides a device embodiment 200 of the present invention having many similarities to the device 100 in FIG. 1, with a main exception being that the individual springs 231, 233, 235 are each housed in different cavity portions 207*a*, 207*b*, 207*c*, respectively. Another difference relative to the embodiment in FIG. 1 is that each of the inner hex keys 210*a-c* extends further in the proximal direction to reach their respective cavity portion 207*a-c*, which obviates the need for guide tube(s) or the like by keeping the springs 231, 233, 235 from interfering with each other, since the springs 231, 233, 235 are compartmentalized and separated from each other by their presence within different cavity portions 207*a-c*.

As shown for example in FIG. 2, one or more radially outward extending ledge(s) may be present at or near the proximal end 210*a-c*" of each of the inner hex keys 210*a-c* that contacts a respective annular flange 208' protruding radially inwardly at or near the distal end of the respective cavity portion 207*a-c*. Such contact by the ledge(s) (present at or near the proximal end 210*a-c*" of the respective hex keys 210*a-c*) with the corresponding annular flange 208' prevents the respective hex key 210*a-c* from moving further in the distal direction. Thus, at least the proximal end 210" of the respective hex key 210 is always kept within its respective cavity portion 207*a-c*. According to some embodiments, a plurality of inwardly protruding projections may alternatively be present at or near the distal end of the respective cavity portion 207 in place of a single annular flange 208'. Similarly, an annular flange, or portions thereof, may alternatively be present at or near the proximal end 210" of the respective hex keys 210*a-c* in place of the radially outward projecting ledge(s).

Continuing with the device embodiment 200 in FIG. 2, springs 231, 233, 235 are also present in the respective cavity portions 207*a-c* between the proximal end 210" of the respective hex key 210*a-c* and the proximal surface 209*a-c* of the respective cavity portion 207*a-c*. Thus, the inner hex keys 210*a-c* and their distal ends 210' are biased to move or slide to their most distal position (i.e., the default position) when an external force is not being applied to the device 200 as a result of the negative tension in respective springs 231, 233, 235 pushing the hex key(s) 210 distally until the radially outward extending ledge(s) at or near the proximal ends 210" of the hex key(s) 210 contact the respective inwardly projecting or protruding flange 208' at or near the distal end of the respective cavity portion 207*a-c*, such that any further distal movement of the hex key(s) is prevented. Only when an external force is applied to the distal end(s) 210' of one or more of the hex key(s) 210 do the respective hex key(s) 210 begin to retract proximally by overcoming the counter force of the respective spring(s) 231, 233, 235.

As the hex key(s) 210 are retracted proximally by application of an external force to the distal end(s) 210' of the hex key(s) 210, the proximal end(s) 210" of those hex key(s) 210 move proximally inside the respective cavity portion 207*a-c* away from their most distal (default) position. According to some embodiments, one or more longitudinally elongated slot(s) 208 may be present along the inner wall(s) of the respective cavity portions 207*a-c*, which may be positioned and sized to accommodate the sliding movement of the corresponding ledge(s) at or near the proximal end 210" of the respective hex key 210 during sliding movement of the respective hex key 210 occurring in response to the application or removal of an external force. For example, ledge(s) at or near the proximal end 210*a*" of the first hex key 210*a* may slide longitudinally in slot(s) 208*a* in the side(s) of the first cavity portion 207*a*, which may be distally limited by flange 208*a*' and proximally limited by the proximal face 209*a* of the first cavity portion 207*a*. Ledge(s) at or near the proximal end 210*b*" of the second hex key 210*b* may slide longitudinally in slot(s) 208*b* in the side(s) of the second cavity portion 207*b*, which may be distally limited by flange 208*b*' and proximally limited by the proximal face 209*b* of the second cavity portion 207*b*. Ledge(s) at or near the proximal end 210*c*" of the third hex key 210*c* may slide longitudinally in slot(s) 208*c* in the side(s) of the third cavity portion 207*c*, which may be distally limited by flange 208*c*' and proximally limited by the proximal face 209*c* of the third cavity portion 207*c*. However, slot(s) may not be present according to other embodiments, and radially extending ledge(s), which may instead be an annular ring or portions thereof, at or near the proximal end of a respective hex key may alternatively slide within the respective cavity portion (i.e., without slot(s)) with a flange at or near the distal end of the cavity portion restricting or stopping further distal movement when the ledge(s) contact the flange.

Figure 2A:
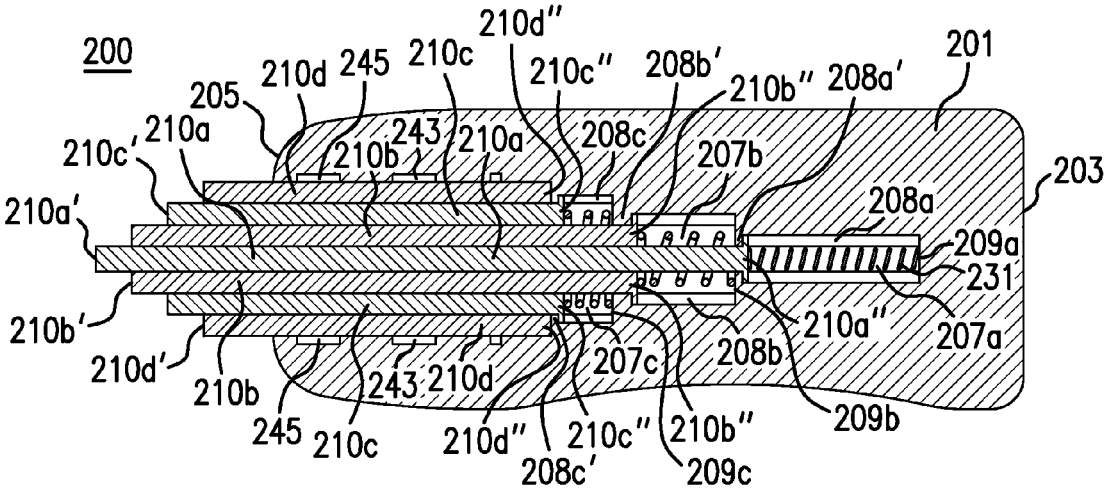
FIG. 2A is a cross-sectional view of a device embodiment of the present invention having individual cavity portions for the hex keys.
Figure 2B:
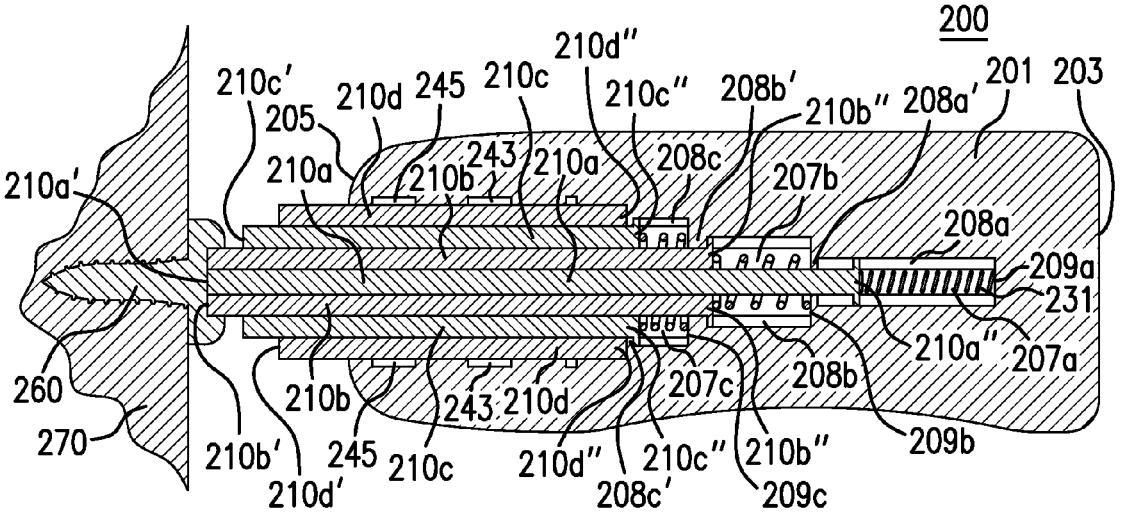
FIG. 2B is a cross-sectional view of the device embodiment in FIG. 2A with the innermost hex key retracted to accommodate the socket of a fastener.

FIG. 2B shows the device embodiment 200 of FIG. 2A but with the innermost and first hex key 210*a* retracted to accommodate the socket size of a fastener 260. In this example, the application of an external force (i.e., the counteracting force of the relatively immovable fastener against the pressing of the device 200 into the fastener socket) first causes the innermost and first hex key 210*a* to become retracted proximally into the handle or base 201 and the bore of the next larger and second hex key 210*b*. This causes the proximal end 210*a*" of the first hex key 210*a* to retract proximally within the first cavity portion 207*a* by compression of the first spring 231 present between the proximal end 210*a*" of the first hex key 210*a* and a first proximal surface or face 209*a* of the first cavity portion 207*a*. Thus, the first hex key 210*a* slidably moves in the proximal direction until the distal end 210*a*' of the first hex key 210*a* becomes approximately even and flush with the distal end 210*b*' of the second hex key 210*b*. As a result, the proximal ends 210*a*', 210*b*' form a common distal end that may closely fit the socket of a fastener, such as the fastener 260 in the example of FIG. 2B.

Although not shown in FIG. 2B, this process could continue sequentially for the embodiment in FIG. 2 in much the same manner to create a common distal end of progressively larger size to accommodate or closely fit a larger sized socket of a fastener by further retraction of the second and/or third hex keys 210*b*, 210*c*. Proximal retraction movement of the second hex key 210*b* may occur until the distal end 210*b*' of the second hex key 210*b* (along with the distal end 210*a*' of the first hex key 210*a*) becomes approximately even and flush with the distal end 210*c*' of the third hex key. To accommodate an even larger fastener socket, proximal retraction movement of the third hex key 210*c* may occur until the distal end 210*c*' of the third hex key 210*c* (along with the distal ends 210*a*', 210*b*' of the first and second hex keys 210*a*, 210*b*) becomes approximately even and flush with the distal end 210*d*' of the fourth hex key 210*d*.

In each of these cases, proximal movement of a respective hex key(s) 210 will cause the proximal end(s) 210" of those hex key(s) 210 to move proximally within their respective cavity portion 207*a-c*. Thus, retraction of the second hex key 210*b* will cause the second spring 233 to become compressed due to the distance between the proximal end 210*b*" of the second hex key 210*b* and a second proximal surface or face 209*b* of the second cavity portion 207*b* being shortened. Likewise, retraction of the third hex key 210*c* will cause the third spring 235 to become compressed due to the distance between the proximal end 210*c*" of the third hex key 210*c* and a third proximal surface or face 209*c* of the third cavity portion 207*c* being shortened.

Once the external force is removed (e.g., by disengaging contact with the fastener), the negative tension in the compressed spring(s) 231, 233 and/or 235 of the device 200 will cause them to become re-extended, which would also cause the retracted hex key(s) 210 to slidably move in the distal direction to their default (i.e., most distally extending) position. As described above, distal movement of each of the retracted hex key(s) 210 (i.e., by re-extension of the compressed spring(s) 231, 233 and/or 235 to relieve their negative tension) will eventually become stopped by the ledge(s) at or near the proximal end 210" of the respective hex key(s) 210 contacting the flange 208' at or near the distal end of the respective cavity portion 207*a-c*.

Figure 3A:
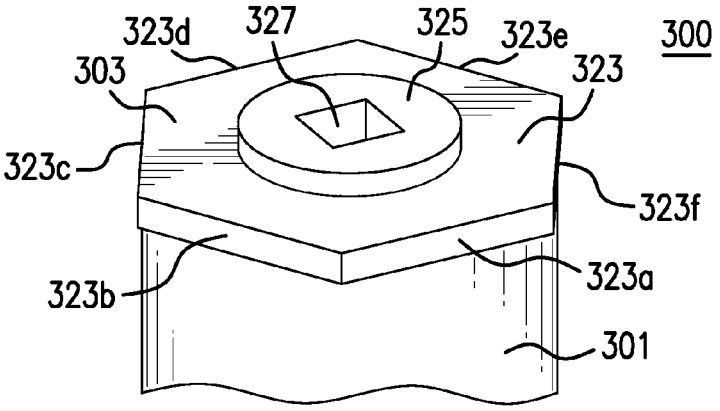
FIG. 3A is a perspective view of the proximal end of a device embodiment of the present invention having a female receiving portion of a ratcheting mechanism and a polygonal neck for turning of the device by a wrench or similar tool.

According to embodiments of the present invention, the base of a concentric hex key device (whether or not it includes a handle) may include a modified proximal portion of the base to provide an additional functionality. According to some embodiments, the base of a device may include a torque-receiving portion or neck which may be engaged by a torque producing tool, such as a wrench, socket, ratchet, nut driver, etc. Such a torque-receiving portion of a device may generally include at least two parallel surfaces in cross-section for engagement by the tool. The torque-receiving portion of the device may instead have an equilaterally polygonal shape in cross-section (i.e., in a plane perpendicular to the longitudinal axes of the hex keys), such as a hexagonal shape, for engagement by a torque producing tool. For example, the device 300 shown in FIG. 3A includes a torque-receiving portion or neck 323 having an equilaterally hexagonal shape at or near the proximal end 303 of the base 301, the hexagonally shaped torque-receiving portion having six side surfaces 323*a-f* for engagement by a tool. The device embodiment 300 in FIG. 3A also includes a female receiving portion 325 for engagement by a male projecting portion of a ratchet tool (not shown) inserted into the receiving hole 327 of the female receiving portion 325. Although shown together in FIG. 3A, the female receiving portion 325 is a separate feature that may be present at or in the proximal end of a device of the present invention apart from a torque receiving portion or neck 323.

Figure 3B:
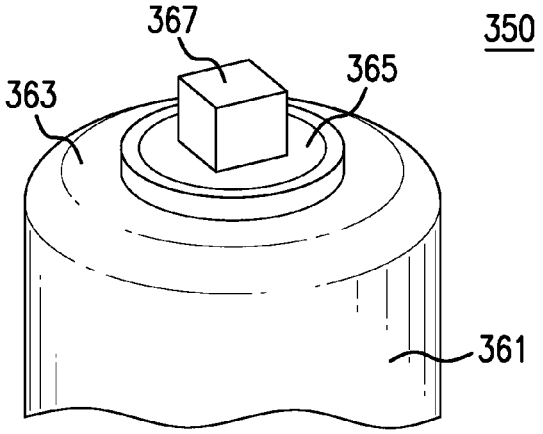

According to some embodiments, a portion of the base of a device of the present invention may include a ratchet mechanism at or near the proximal end of the base. For example, a device embodiment 350 of the present invention is shown in FIG. 3B having a ratchet or ratchet mechanism 365 inside a portion of the base 361 at or near its proximal end 363. The ratcheting mechanism 365 may include a male projecting portion 367 that may be engaged by a corresponding female receiving portion of a handle tool (not shown). Although not shown in FIG. 3B, the orientation of the ratcheting mechanism in the proximal end of the base may also be reversed according to other embodiments, such that the ratcheting mechanism instead has a female receiving portion instead of male projecting portion.

Figure 3C:
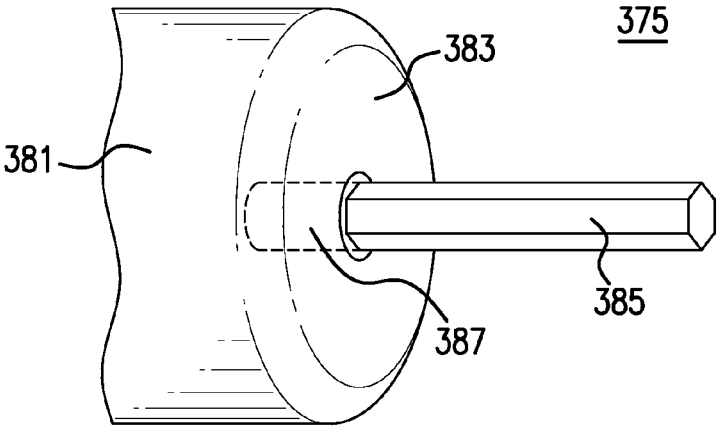

According to other embodiments, a device of the present invention may also have a bit projecting proximally from its proximal end for engagement by a drill. For example, a device embodiment 375 is shown in FIG. 3C having a bit 385 with a proximal projecting portion extending proximally from a proximal end 383 of the base 381 of the device 375. For secure attachment of the bit 385 to the base 381, a distal portion 387 of the bit 385 may be inserted into a portion of the base 381 at or near its proximal end 383. Although not shown, additional pieces, structures, etc., may also be present to help secure the attachment of the bit 385 to the base 381.

According to other embodiments of the present invention, the positioning of the distal end(s) of one or more of the concentric hex key(s) may be determined at least in part by an adjustment mechanism that is part of the device itself and separate from any external force(s) that may be applied to one or more of the distal end(s) of the hex key(s). Such an adjusting mechanism may include a means for directly or indirectly contacting, pushing and/or pulling the proximal end(s) of one or more of the hex key(s) to cause either extension or retraction of one or more of the hex key(s), perhaps in cooperation with force(s) generated by one or more biasing springs acting on the individual hex key(s). According to many embodiments, an adjusting mechanism as part of a device may include a threaded shaft that is engaged with a threaded bore, the threaded bore spanning from the proximal end of a handle or base of the device to an internal cavity of the device that houses the spring(s). Thus, rotation of the threaded shaft may cause the distal end of the threaded shaft (along with the rest of the threaded shaft) to move distally if rotated in one direction and proximally if rotated in the other direction. Accordingly, rotation in either direction may affect the positioning of the hex key(s) by acting directly or indirectly on (e.g., by physically pushing or pulling) the proximal end(s) of one or more of the hex key(s).

Figure 4A:
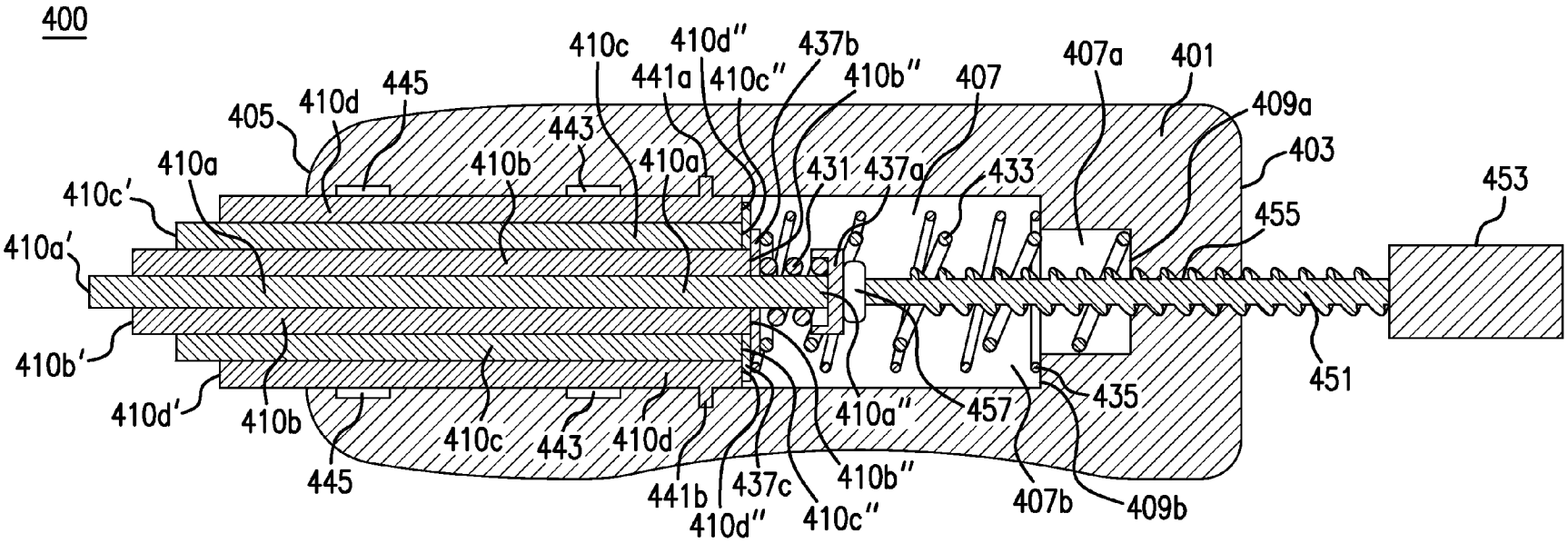
FIG. 4A is a cross-sectional view of a device embodiment of the present invention having an adjusting mechanism to change the size of the common distal end of the hex keys for accommodating the socket of a fastener.

A device embodiment 400 of the present invention is provided in FIG. 4A. The device 400 has a threaded shaft 451 engaged with a threaded bore 455. A contacting portion 457 is present at the distal end of the shaft 451, and a knob 453 is shown fixedly attached at the proximal end of the shaft 451 for gripping and rotation by the hand of a user. The knob 453 basically provides a simple, facilitated means for causing rotation of the shaft 451 by hand. Rotation of the knob 453 and shaft 451 in one direction will cause the distal contacting portion 457 to move distally, whereas rotation of the knob 453 and shaft 451 in the other direction will cause the distal contacting portion 457 to move proximally (depending on the direction of the threading). As shown in FIG. 4A, distal contacting portion 457 is shown contacting a first proximal end piece 437*a* directly or indirectly attached, connected, etc., to the proximal end 410*a*" of the innermost or first hex key 410*a*. A first spring 431 is also shown between a distal face of the first proximal end piece 437*a* and the proximal face of a second proximal end piece 437*b* directly or indirectly attached, connected, etc., to the proximal end 410*b*" of the second hex key 410*b*. The first proximal end piece 437*a* not only has a distal face for contact with the first spring 431, first proximal end piece 437*a* may also have forward or distally extending side(s) that help to keep the proximal end of the first spring 431 in place and prevented from sliding off the first proximal end piece 437*a*. Although distal contacting portion 457 is shown in FIG. 4A as being a piece that is separate from, but attached to, the distal end of the threaded shaft 451, the distal contacting portion 457 may instead be a similar structure that is a continuous portion of the threaded shaft 451 at its distal end.

According to the embodiment in FIG. 4A, rotation of the threaded shaft 451 to cause distal movement of the contacting portion 457 at the distal end of the shaft 451 will push or force the first proximal end piece 437*a* and the first hex key 410*a* in a distal direction due to compression of the first spring 431. As a result, the first hex key 410*a* will move distally by compression of the first spring 431 until it cannot be further compressed. Conversely, rotation of the shaft 451 in the opposite direction will cause proximal movement of the contacting portion 457, and the proximal end piece 437*a* (along with the distal end 410*a*" of the first hex key 410*a*) will also move proximally due to decompression of the first spring 431.

During movement of the adjusting mechanism (i.e., the threaded shaft 451), contact may be maintained between the distal contacting portion 457 and the proximal end piece 437*a* (and/or proximal end 410*a*" of the first hex key 410*a*) by the force of the first spring 431 pushing them together. Since the distal end of the shaft 451 must rotate relative to the first hex key 410*a*, a fixed connection may not exist between the shaft 451 and the first hex key 410*a*. Thus, distal contacting portion 457 may be required to rotate or spin relative to the proximal end piece 437*a* and/or the proximal end 410*a*" of the first hex key 410*a*. However, the distal contacting portion 457 may be attached or integral with the proximal end piece 437*a* and/or the proximal end 410*a*" of the first hex key 410*a* if the threaded shaft 451 is allowed to rotate relative to one or more of the distal contacting portion 457, the proximal end piece 437*a*, and/or the proximal end 410*a*" of the first hex key 410*a*. For example, a rotatable bearing engagement and attachment (not shown) may be present between the shaft 451 and the first hex key 410*a*.

Because the distal face of the second proximal end piece 437*b* (at the proximal end 410*b*" of the second hex key 410*b*) meets the proximal face of the third proximal end piece 437*c* (at the proximal end 410*c*" of the third hex key 410*c*), the second hex key 410*b* will also be pushed distally by compression of the first spring 431. Likewise, because the distal face of the third proximal end piece 437*c* at the proximal end 410*c*" of the third hex key 410*c* meets the proximal end 410*d*" of the fourth hex key 410*d*, the third hex key 410*c* will also be pushed distally by compression of the first spring 431. Although each of the proximal end pieces 437*a-c* is shown being separate from (albeit attached, connected, etc., to) the proximal end 410" of each hex key 410, each proximal end piece 437 may not be separate but may instead be a structure that is integral and continuous with, and/or part of, the proximal end 410" of the respective hex key 410 (similar to the embodiments in FIGS. 1-2).

With the embodiment in FIG. 4A, counteracting the distal movement of the second and third hex keys 410*b*, 410*c* are the second and third biasing springs 433, 435, respectively, present in the cavity 407 of the handle or base 401 of the device 400. However, unlike the springs described above, second and third springs 433, 435 may instead be a tension spring that resists being extended due to stretching of the helical spring. Thus, the second spring 433 may resist distal movement of the second hex key 410*b* by its direct or indirect attachment at one end to the proximal face 409*a* of the first cavity portion 407*a* and at the other end to the proximal end 410*b*" (e.g., via the second proximal end piece 437*b*) of the second hex key 410*b*. Likewise, the third spring 435 may resist distal movement of the third hex key 410*c* by its direct or indirect attachment at one end to the proximal face 409*b* of the second cavity portion 407*b* and at the other end to the proximal end 410*c*" of the third hex key 410*c*. Thus, when the contacting portion 457 is moved proximally, the third and/or fourth hex keys 410*b*, 410*c* may also be pulled proximally due to the existing tension in the second and/or third springs 433, 435, respectively.

Again, although the second and third proximal end pieces 437*b*, 437*c* are shown as being separate from (albeit attached, connected, etc., to) the proximal ends 410*b*", 410*c*", respectively, of the second and third hex keys 410, 410*c*, a similar structure could instead be integral and continuous with, and/or form part of, the proximal ends 410*b*", 410*c*", respectively, of the second and third hex keys 410*b*, 410*c*. Thus, for purposes of the present invention, the term "proximal end piece" for each of the inner hex keys means either a piece that is separate from, but attached to, the proximal end of the respective hex key, or a similar structure that is a continuous portion of the respective hex key (i.e., a proximal end portion) at or near the proximal end of the respective hex key. In either case, however, such a proximal end piece 437 (or proximal end structure) may include one or more ledge(s) and/or an annular ring (or portions thereof) that may project or extend radially outward at or near the proximal end of the hex key (similar to the ledge(s) in FIGS. 1-2) for contacting the proximal end piece 437 or proximal end 410" of the next larger hex key 410.

From a fully extended position of the device 400 as shown in FIG. 4A with the first spring 431 compressed and the second and third springs 433, 435 stretched and extended, the hex keys 410*a-c* may be individually and sequentially retracted from their extended position to form a common distal end of progressively larger size. To cause sequential retraction of the hex keys (i.e., the first hex key, then the second, then the third, etc.), springs of decreasing wire diameter may be used for each of the successively retracted hex keys. Accordingly, the hex key associated with the spring having the largest wire diameter will become retracted first because it is experiencing the greatest negative tension force, then the hex key associated with the spring having the second largest wire diameter will become retracted second, and so on.

Thus, assuming all other factors being equal, the hex key having a spring with the largest wire diameter acting on it will become retracted first because the negative tension in the spring is preferentially relieved first. Thus, the relative wire diameters of the springs may be used to cause a preferential sequence of retraction and/or extension of hex keys due to their different tension forces. However, other known parameters affecting the amount of force required to compress or extend/stretch a spring (i.e., the amount of tension force (negative or position) created by compression or extension of the spring) may also be used to affect the order of sequential retraction or extension of the hex keys. For example, the number of coils per length of the spring (more coils causes more tension force for a given amount of compression/extension) and/or the total length of the spring (longer spring length causes less tension force for a given amount of compression/extension) may affect the amount of tension generated in a spring upon its compression or extension. Thus, the ordered progression of retraction or extension of the hex key(s) may be determined by the relative force of tension generated by compression or extension of the spring, which may be due to factor(s) other than (and/or in addition to) wire diameter. Regardless of the factors involved, the "force of tension" or "tension force" of a spring is the amount of linearly outward or inward force exerted by the spring at a given moment in time as a result of its compression or extension, respectively. Similarly, the "strength of tension" or "tension strength" of a spring is related to the amount of linearly outward or inward force exerted by the spring with a given amount of compression or extension, respectively. Thus, a spring having a greater "tension strength" would exert more pushing or pulling force on opposing surfaces with a given amount of compression or extension than another spring having a lesser "tension strength" that is identically compressed or extended.

According to the embodiment in FIG. 4A, the first spring 431 has the greatest wire diameter and thus exerts a greater force against opposing surfaces when compressed, whereas the second spring 433 has an intermediate wire diameter, and the third spring 435 has a smallest wire diameter. Thus, as the threaded shaft 451 and the distal contacting portion 457 are retracted by rotation of the threaded shaft 451 in one direction, the first hex key 410*a* will become retracted first because the negative tension in the first spring is greater than the tension in either the second or third springs 433, 435 (i.e., due to its greater wire diameter). It is important to note, however, that the first innermost spring 410*a* may need to be attached to the proximal end 410*a*" and/or the first proximal end piece 437*a* of the first hex key 410*a* for the first hex key 410*a* to continue to retract after the negative tension in the first spring 431 is relieved or lost. Otherwise, the distal contacting portion 457 of the adjusting mechanism may begin to physically separate from the proximal end 410*a*" and/or the first proximal end piece 437*a* of the first hex key 410*a* as the shaft 451 is further retracted. However, as long as some negative tension is maintained in the first spring 431, then the proximal end 410*a*" and/or the first proximal end piece 437*a* of the first hex key 410*a* should continue to retract and not separate from the distal contacting portion 457 of the adjusting mechanism.

Only after the threaded shaft is sufficiently retracted and the negative tension in the first spring 431 is sufficiently relieved, the tension in the second spring 433 will begin to exceed the remaining negative tension in the first spring 431. The third spring 435, however, would not begin to retract at this point because of the second spring 433 having a greater wire diameter. Thus, the second hex key 410*b* will begin to retract instead of the continued retraction of the first hex key 410*a* (i.e., the first and second hex keys 410*a*, 410*b* will begin to retract together). Similarly, with continued retraction of the threaded shaft 451, once the tension in the second spring 433 is sufficiently relieved, the tension in the third spring 435 will begin to exceed the remaining tension in the second spring 433. Thus, the third hex key 410*c* will begin to retract instead of the continued retraction of the second hex key 410*b* (i.e., the first, second and third hex keys 410*a-c* may begin to retract together). If the threaded shaft 451 were rotated in the opposite direction, the shaft 451 and contacting portion 457 would instead move in a distal direction to cause outward extension of the distal end(s) 410' of the hex key(s) 410 in the distal direction, and the above process would occur in a reverse order.

Although not depicted in FIG. 4, there may be an additional order transition mechanism, which may include for example one or more projection(s) and corresponding slot(s) in adjacent hex keys, to ensure that the relative movement of the hex key(s) stays within a certain range. Such a feature may be used to ensure that the retraction of one hex key transitions at the appropriate time to the next larger or smaller hex key. It may be difficult to have such a precise transition(s) occur between adjacent and contiguous hex keys on the basis of the relative tension strengths of the biasing springs alone. Thus, the springs may be used to determine the order of retraction or extension with the additional order transition mechanism overriding the relative tension strengths in the springs when a desired amount of relative retraction or extension between adjacent hex keys is achieved. For example, from a fully extended state, it is desirable for the first and innermost hex key to stop retracting by itself when its distal end becomes approximately even and flush with the distal end of the next larger hex key. However, from a fully retracted state, ordered extension of the springs may be determined by contact between the ledge(s) and/or proximal end piece(s) at or near the proximal ends of the respective hex keys.

Figure 4B:
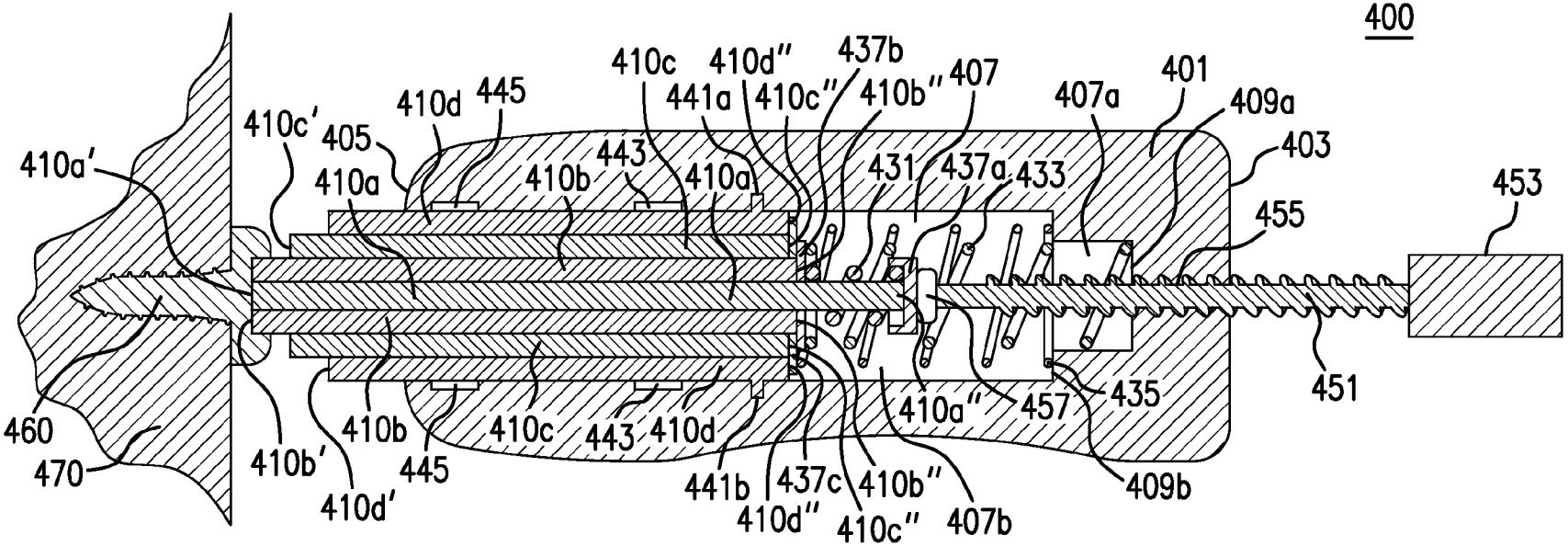
FIG. 4B is a cross-sectional view of the device embodiment in FIG. 4A with the innermost hex key retracted by the adjusting mechanism to change the size of the common distal end of the hex keys and accommodate the socket of a particular fastener.

FIG. 4B shows an alternative state for the device 400 in FIG. 4A showing the first and innermost hex key 410*a* retracted due to retraction of the threaded shaft 451 by its rotation. As described above, the first hex key 410*a* is retracted first due to the first spring 431 having the greatest wire diameter and force of tension. As shown in this figure, the first hex key 410*a* is retracted preferably until the distal end 410*a*' of the first hex key 410*a* becomes approximately flush and even with the distal end 410*b*' of the second hex key 410*b*. Thus, the common distal end of the device 400 becomes appropriately sized to fit the socket of a fastener 460. Likewise, although not shown in FIG. 4B, the second hex key 410*b* will eventually begin to retract when the force of tension in the second spring 433 begins to exceed the tension in the first spring 431 to form a common distal end having a larger size, and the third hex key 410*c* will eventually begin to retract when the force of tension in the third spring 435 begins to exceed the tension in the second spring 433 to form a common distal end having an even larger size.

Figure 4C:
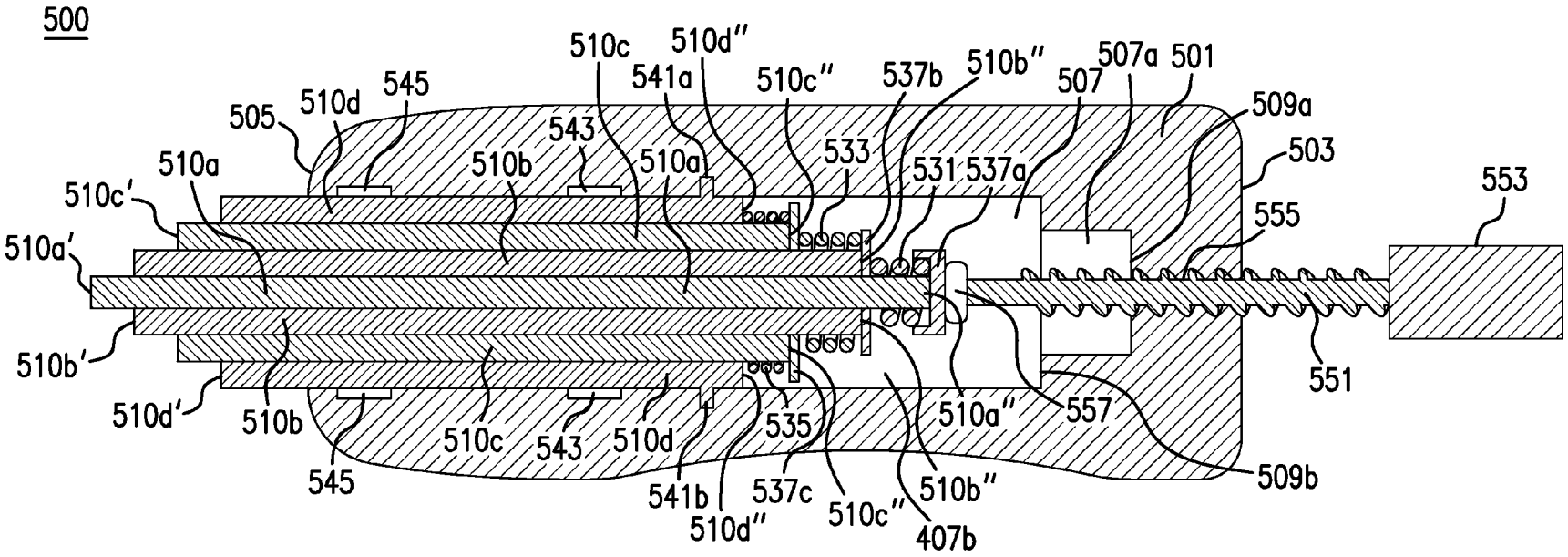
FIG. 4C is a cross-sectional view of another device embodiment of the present invention having an adjusting mechanism to change the size of the common distal end of the hex keys for accommodating the socket of a fastener.

FIG. 4C shows another device embodiment 500 of the present invention. The device embodiment 500 in FIG. 4C is similar in many ways to the device embodiment 400 in FIG. 4A. Therefore, a redundant description is not provided for the same or similar components and features of the device 500 in FIG. 4C. The main difference between the embodiments in FIGS. 4A and 4C is the placement and manner of operation of the biasing springs. In FIG. 4C, the first spring 531 is similarly placed between the first distal end piece 537*a* (attached, connected, etc., to the proximal end 510*a*" of the first hex key

510*a*) and the second distal end piece 537*b* (attached, connected, etc., to the proximal end 510*b*" of the second hex key 510*b*). However, unlike FIG. 4A, the second spring 533 in FIG. 4C operates by compression (not extension) and is positioned and placed (similarly to the first spring 531) between the second distal end piece 537*b* (attached, connected, etc., to the proximal end 510*b*" of the second hex key 510*b*) and the third distal end piece 537*c* (attached, connected, etc., to the proximal end 510*c*" of the third hex key 510*c*. Likewise, the third spring 535 also operates by compression (not extension) and is positioned and placed between the third distal end piece 537*c* (attached, connected, etc., to the proximal end 510*c*" of the third hex key 510*c*) and the proximal end 510*d*" of the fourth hex key 510*d*.

Similarly to the device embodiment 400 in FIG. 4A, the springs in FIG. 4C may have progressively smaller wire diameters to cause the sequential retraction of the hex keys in much the same manner as in FIGS. 4A and 4B. Thus, from a fully compressed and distally extending position as shown in FIG. 4C, proximal retraction of the threaded shaft 551 by its rotation in one direction will first cause the first hex key 510*a* to retract by decompression of the first spring 531 while the other two springs 533, 535 remain relatively compressed (due to the first spring having the greatest wire diameter and force of negative tension). For example, as shown in FIG. 4D, the shaft 551 of the device embodiment 500 in FIG. 4C may be retracted by decompression of the first spring 535 until the distal end 510*a*' of the first hex key 510*a* becomes approximately even and flush with the distal end 510*b*' of the second hex key 510*b* to form a common distal end having a larger size to accommodate the socket size of the fastener 460.

Figure 4D:
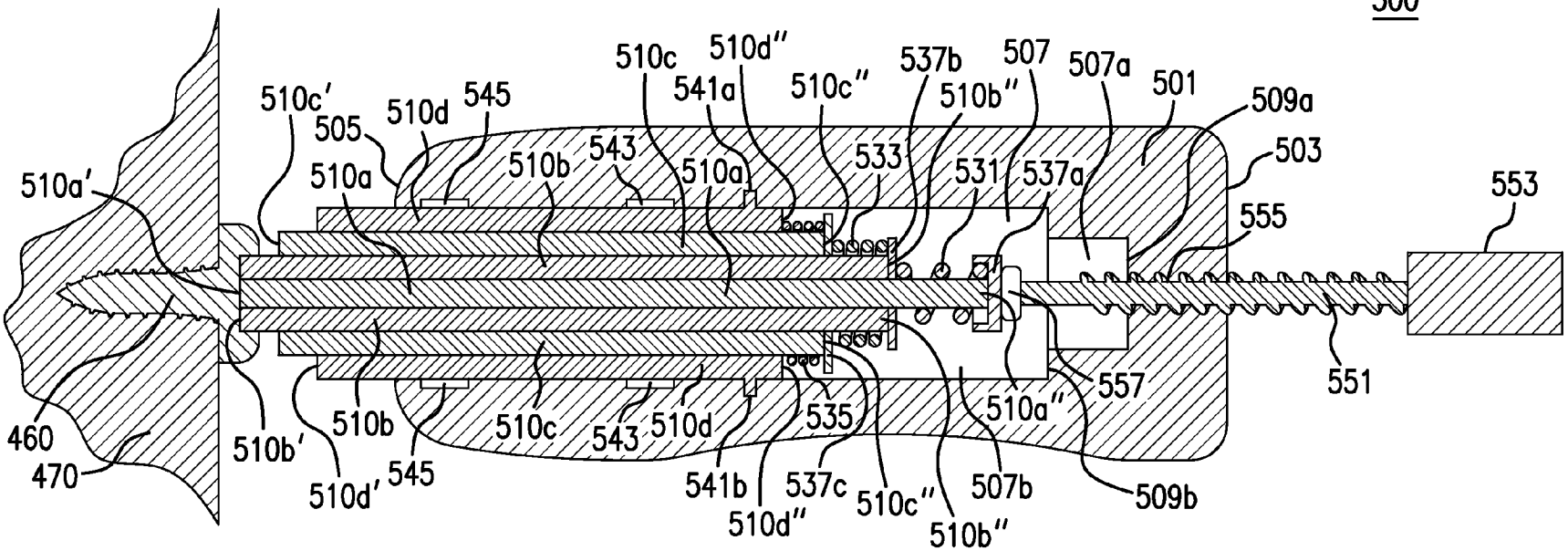
FIG. 4D is a cross-sectional view of the device embodiment in FIG. 4C with the innermost hex key retracted by the adjusting mechanism to change the size of the common distal end of the hex keys and accommodate the socket of a particular fastener.

Although not shown in FIG. 4D, after the threaded shaft is sufficiently retracted and the negative tension in the first spring 531 is sufficiently relieved, the negative tension in the second spring 533 will begin to exceed the remaining negative tension in the first spring 531. The third spring 535, however, would not begin to extend at this point because of the second spring 533 has a greater wire diameter and force of tension. Thus, the second hex key 510*b* will begin to retract instead of the first hex key 410*a* continuing to retract (i.e., the first and second hex keys 510*a*, 510*b* will begin to retract together). Eventually, with continued retraction of the threaded shaft 551, the tension in the second spring 533 will become sufficiently relieved, and the negative tension in the third spring 535 will begin to exceed the remaining tension in the second spring 533. Thus, the third hex key 510*c* will begin to retract (instead of the continued retraction of the second hex key 510*b*), and the first, second and third hex keys 510*a-c* may begin to retract together. Like with the embodiment 400 in FIG. 4A, if the threaded shaft 551 were rotated in the opposite direction, the shaft 551 and contacting portion 557 would instead move in a distal direction to cause outward extension of the distal end(s) 510' of the hex key(s) 510 in the distal direction, and the above process would occur in a reverse order. As with FIGS. 4A and 4B, an additional order transition mechanism may be present between contiguous hex keys to encourage or determine proper transition timing in the retraction/extension of the hex keys.

According to another set of embodiments, a rotating knob or handle portion or rotating proximal portion may be present that may have a similar cross sectional size as the main body portion. The rotating knob or handle portion may be coupled to a main body portion by one or more side bracket(s) that may each vary greatly in their size, shape, configuration and manner of attachment. The main body portion may be the same or similar to the base or holder described above with regard to other embodiments. Thus, the rotating knob or handle portion may be similarly described as being coupled to a holder or base of a device by one or more side bracket(s). An adjusting mechanism, including a threaded shaft may be present, such as described above in connection with FIGS. 4A-4D, the shaft causing proximal retraction or distal extension of the distal end(s) of the hex key(s) based on the direction of rotation and movement of the shaft in response to rotation of the rotating knob or handle portion due to the engagement of the threaded shaft with a corresponding threaded bore that spans from the proximal end of the main body portion to a cavity inside the main body portion. Thus, rotation of the shaft in one direction would cause the shaft (and its distal contacting portion) to move distally and push the first hex key in a distal direction due to its direct or indirect contact or engagement with a proximal end piece (attached, etc., to the proximal end of the first hex key) and/or the proximal end of the first hex key. Such forces imparted to the first hex key would also be communicated to the second and third hex keys to cause them to be pushed distally as well. For similar reasons, rotation of the shaft in the other direction would cause the shaft (and its distal contacting portion) to move proximally and pull the first hex key in a distal direction. To cause progressive or sequential movement of the hex key(s) in the proximal or distal direction in a desired order, different biasing springs having different properties and tension forces upon compression or extension may be used.

However, the shaft according to these embodiments would also be engaged with a threaded bore inside the rotating handle portion that is aligned with the threaded bore of the main body portion. Thus, to impart rotational motion to the shaft and cause retraction or extension of the hex key(s), the knob or handle portion may be rotated, and the shaft would thus be moved in either the proximal or distal direction due to its engagement with the threaded bore inside the rotating knob or handle portion. However, it is also conceivable that the shaft engaged with the threaded bore of the rotating knob or handle portion may only be inserted through a non-threaded bore of the main body portion spanning from its proximal end to the cavity.

Figure 4E:
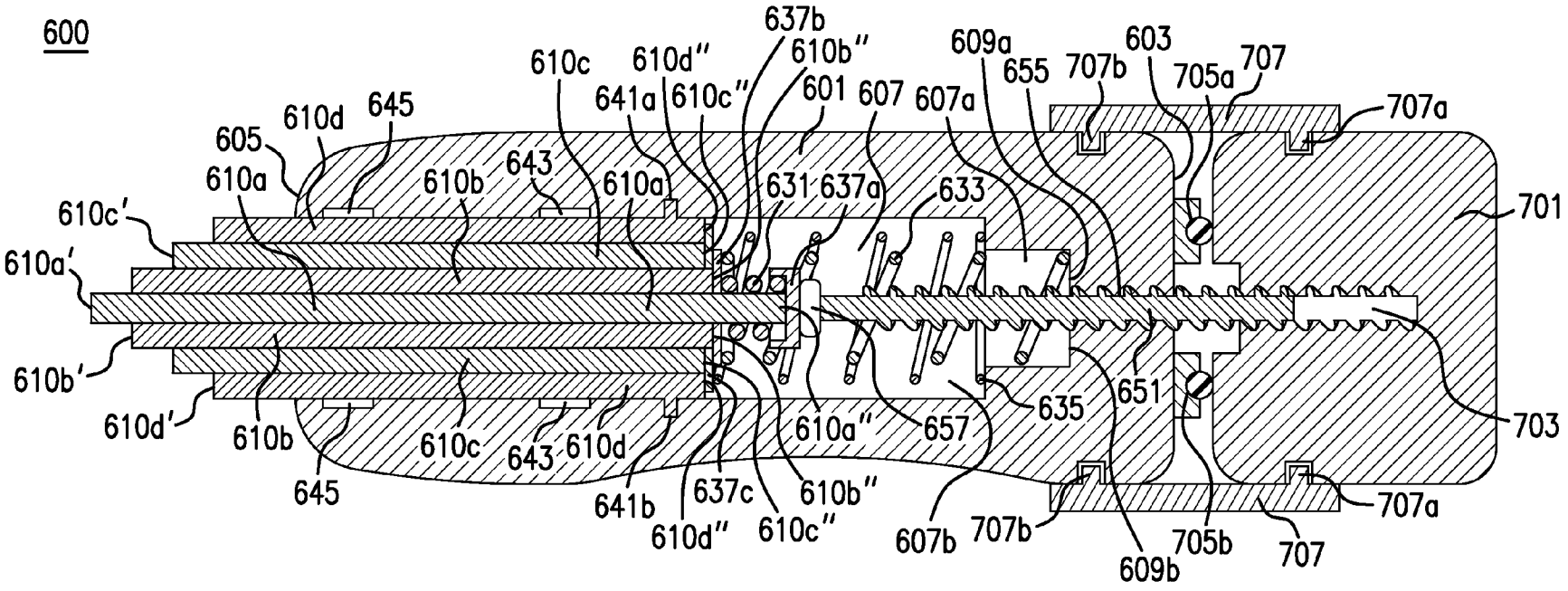
FIG. 4E is a cross-sectional view of another device embodiment of the present invention having an adjusting mechanism with a rotating top portion to change the size of the common distal end of the hex keys for accommodating the socket of a fastener.

According to a device embodiment 600 of the present invention as shown in FIG. 4E, a rotating knob or handle portion 701 may be attached by a side bracket(s) 707 to a main body portion 601, such as by respective inwardly projecting rings or flanges 707*a*, 707*b*. These inwardly projecting rings or flanges 707*a*, 707*b* may be inserted into corresponding slot(s), notch(es), recessed area(s), etc., for the side bracket(s) to hold the rotating portion and main body portion in place, such that a generally fixed spacing is maintained between them. Although the embodiment 600 in FIG. 4E shows bracket(s) 707 projecting out from the side of the rotating portion 701, it is also possible for the coupling bracket(s) 707 to instead be recessed or sunk into the respective sides of the rotating portion 701 and/or the main body portion 601 to provide a more consistent profile to the device 600. In addition, each of the inwardly projecting rings or flanges 707*a*, 707*b* may instead be one or more inwardly extending projection(s), etc.

Aligned with the threaded main bore 655 in the main body portion 601, which spans from the proximal end 603 of the main body portion 601 to the first cavity portion 607*a* of the inner cavity 607, is a threaded receiving bore 703 in the rotating portion 701 of the device 600. Both the threaded main bore 655 and the threaded receiving bore 703 are aligned and configured (when the main body portion 601 and the rotating portion 701 are coupled together) to jointly receive the threaded shaft 651. The threaded receiving bore 703 will have a sufficient length to accommodate the full range of retraction or extension movement of the shaft 651 (i.e., there will be a gap or spacing inside the threaded head bore 703 between the proximal end of the shaft 651 and the proximal end of the receiving bore 703) when the shaft 651 and hex key(s) are more distally extended. Such a gap or spacing will provide room or space for the proximal end of the shaft 651 to move proximally inside the receiving bore 703 for retraction of the hex key(s) 610 while the rotating portion 701 is turned by hand.

Retraction of the shaft 651 and hex key(s) 610 may be achieved by rotating the rotating knob or handle portion 701 in one direction which causes the shaft 651 to move proximally or distally due to the threaded engagement between the rotating portion 701 and the shaft 651 and the fixed distance between the rotating portion 701 and the main body portion 601 due to their coupling together. For example, FIG. 4E shows the hex key(s) 610 fully extended distally with each of their respective springs 631, 633, 635 under tension—i.e., first spring 631 is compressed between the proximal end pieces 637*a*, 637*b*, while second and third springs 633, 635 are stretched and under tension (similarly to FIG. 4A) due to their attachment at one end to the proximal face 609*a*, 609*b* of a respective cavity 607*a*, 607*b* and at the other end to the proximal end 610" or the proximal end piece 637*b*, 637*c* of a respective hex key 610*b*, 610*c*.

Figure 4F:
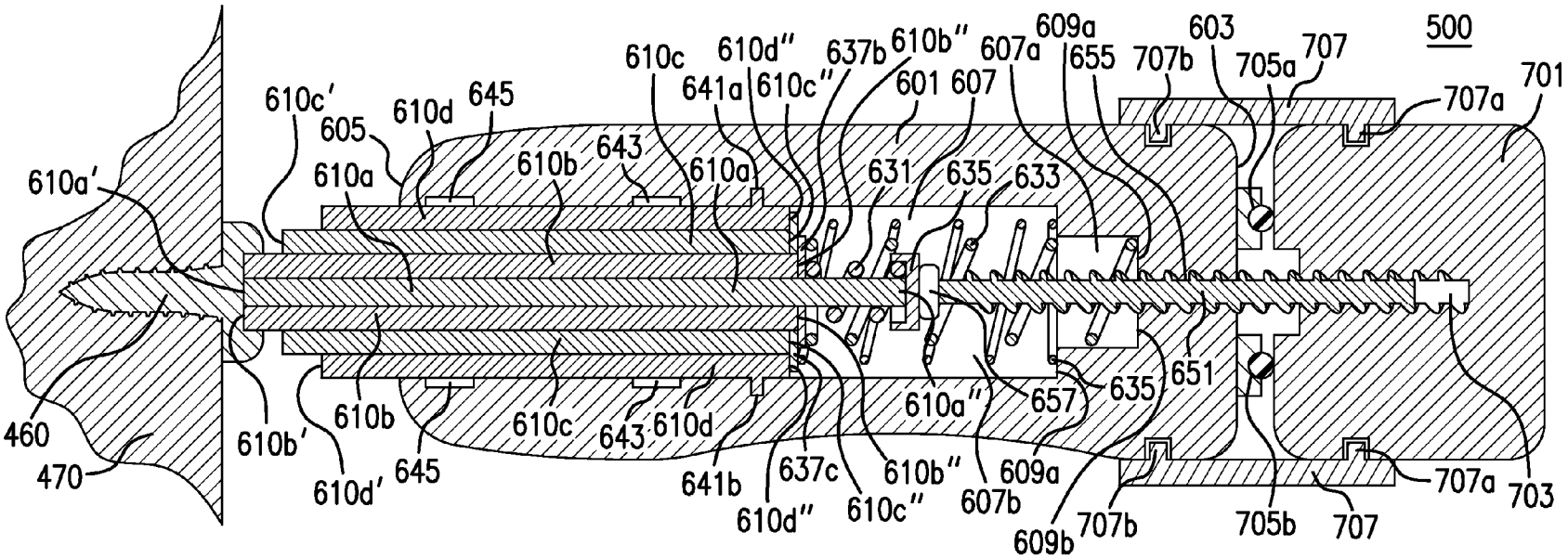
FIG. 4F is a cross-sectional view of the device embodiment in FIG. 4A with the innermost hex key retracted by the adjusting mechanism to change the size of the common distal end of the hex keys and accommodate the socket of a particular fastener.

Relative to FIG. 4E, retraction of the shaft 651 by rotation in one direction of the rotating knob or handle portion 701 engaged with the shaft 651 via its threaded receiving bore 703 allows the first hex key 610*a* to retract by decompression of the first spring 631 until the distal end 610*a*' of the first hex key 610*a* becomes approximately even and flush with the distal end 610*b*' of the second hex key 610*b* to form a common distal end of larger size, which may closely fit the socket of a fastener 460 as shown in FIG. 4F. Additional structures and features may be present to facilitate or improve the rotational engagement between the rotating knob or handle portion 701 and the main body portion 601, such as bearing engagements 705*a*, 705*b*, which may facilitate or lessen, reduce, etc., any friction or other resistance to rotational movement of the rotating knob or handle portion 701 relative to the main body portion 601.

This process may again be repeated for larger sized sockets by continuing to rotate the rotating portion 701 of the device 600 in the same direction to cause sequential and progressive retraction of additional hex key(s) 610 by relieving tension on the second and/or third springs 633. 635 until a common distal end is formed having the appropriately sized dimensions for a given fastener socket. As described above, the sequential retraction or extension of the hex key(s) may be achieved by using springs having different properties, such as different wire diameters, to cause them to exert different tension forces when compressed or extended, such that their positive or negative tension is relieved in a preferential order to thus cause the proximal retraction or distal extension movements of the hex key(s) to occur sequentially. As with FIGS. 4A through 4D, an additional order transition mechanism may be present between contiguous hex keys to encourage proper transition timing in the retraction/extension of the hex keys.

The remainder of the device 600 including the internal parts of the main body portion 601 is highly similar to the analogous features of the embodiment 400 in FIGS. 4A and 4B. Therefore, they will not be redundantly described. The remainder of the device 600 including the internal parts of the main body portion 601 could also be the same or similar to the analogous features of the device embodiment 500 in FIGS. 4C and 4D. The main differences in FIG. 4E relate to the manner in which rotation and movement may be imparted to the threaded shaft 651 (i.e., by coupling of a rotating portion 701 to the base portion 601 at a fixed distance with freedom of movement by the shaft 651 within a threaded receiving bore 703 of the rotating portion 701 of the device 600 as shown and described).

Figure 4G:
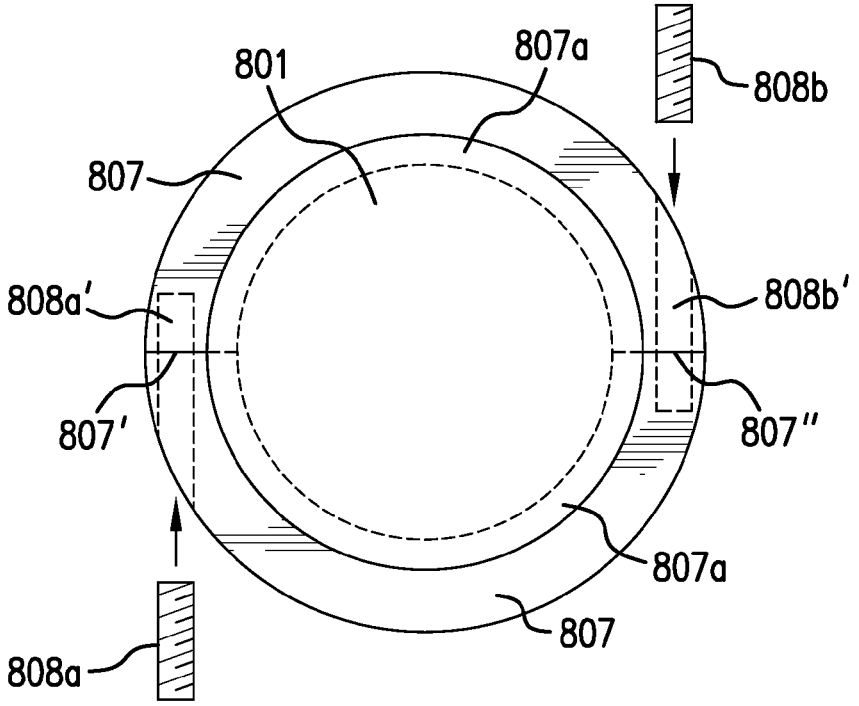
FIG. 4G is a view of the proximal end of a device embodiment showing a bracket for coupling the top rotating portion to the main body portion of the device.

FIG. 4G provides a proximal view of a device of the present invention having a main body portion (not visible) and a rotating portion 801 similarly to FIGS. 4E and 4F with the main body portion (not visible) and rotating portion 801 being coupled and joined together by a side bracket 807 having inwardly projecting ring(s) or flange(s) 807*a* that project into a corresponding slot, etc., to hold the main body portion and rotating portion 801 together at a generally fixed distance or separation. According to this embodiment, the side bracket 807 comprises two parts or halves that are joined together along seams 807', 807". Threaded bores 808*a*', 808*b*' are further shown to receive threaded fasteners 808*a*, 808*b* to hold the two parts or halves of the side bracket 807 together.

Figure 4H:
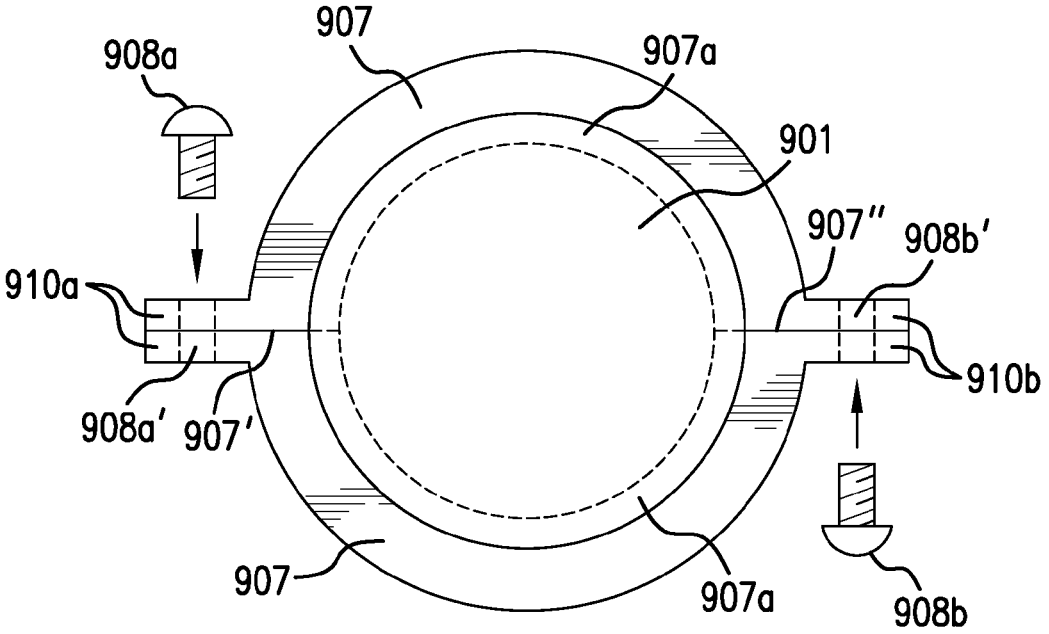
FIG. 4H is a view of the proximal end of another device embodiment showing a bracket for coupling the top rotating portion to the main body portion of the device.

FIG. 4H provides a proximal view of a similar embodiment having a rotating portion 901 joined to a main body portion (not visible) by a side bracket 907 having inwardly projecting ring(s), flange(s), etc., 907*a* that engage corresponding slot, etc., to hold the main body portion and rotating portion 901 together at a generally fixed distance or separation. According to this embodiment, the side bracket 907 comprises two parts or halves that are joined together along seams 907', 907". Threaded bores 908*a*', 908*b*' are further shown to receive threaded fasteners 908*a*, 908*b* to hold the two parts or halves of the side bracket 907 together. In contrast to FIG. 4G, threaded bores 908*a*', 908*b*' are shown through side projecting portions 910*a*, 910*b* of the bracket 907 at seams 907', 907".

According to some device embodiments of the present invention, a hex key selection mechanism is provided for determining which hex key(s) are extended by user selection. A distally extending adjusting arm connected to a rotating knob or handle portion of the device may engage a portion or structure of a selected hex key among a plurality of concentric hex keys (housed in a main body portion which is coupled to the rotating knob or handle portion) to cause the distal end of that hex key to become extended with distal movement of the adjusting arm. Distal movement and extension of each of the hex keys may be opposed by a respective biasing spring that causes the hex key to assume a more proximal default position when not engaged by the adjusting arm. In other words, the force exerted by the adjusting arm against a portion of the hex key may cause the hex key to become distally extended only by overcoming the proximally biasing spring for that hex key.

Distal movement of the rotating knob or handle portion to cause extension of the selected hex key(s) may be carried out by hand or by action of a spring positioned between surfaces of the coupled rotating portion and main body portion of the device. A series of spaced-apart notches may be present around the periphery of the main body portion near its proximal end may be used to help guide the alignment of the adjusting arm with the selected hex key by selective insertion or engagement of a tab of the rotating portion with one of the notches on the main body portion. Alternatively, one or more outwardly projecting tab(s) may be present on the rotating portion to engage one or more channel(s) or slot(s) on an inner side surface of the main body portion to guide the alignment of the adjusting arm with the selected hex key.

Figure 5A:
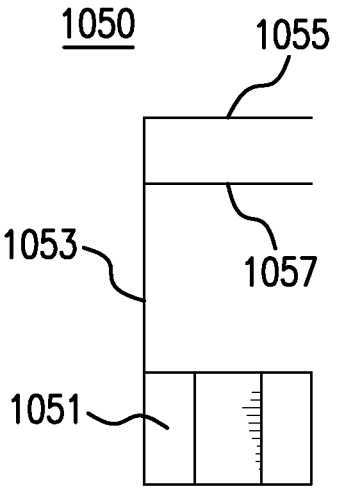
FIGS. 5A-D are side views of individual hex keys of different sizes that may be concentrically arranged inside one another, the individual hex keys each having a respective proximally extending portion for engagement by an adjustment and selection mechanism.

According to these embodiments, each hex key may have a portion or structure that engages a separate portion or structure of another adjacent hex key (e.g., a next smaller hex key) to cause the two hex keys to become extended together. Thus, the adjusting arm engaging the first hex key will cause the first hex key to become extended, and a portion or structure of the first hex key may also engage a portion or structure of a (next smaller) second hex key to cause the second hex key to be jointly extended with the first hex key. This manner of coextension may be further applied to additional hex key(s)—e.g., a portion or structure of the second hex key may engage a third (next smaller) hex key to cause its co-extension with the first and second hex keys, and so on. However, a user may choose to not select the first hex key but instead have the adjusting arm directly engage the second key, such that the second, third, etc., hex key(s) may be extended while the first hex key remains retracted. In general, this selection mechanism will cause only the hex key(s) that are smaller (if any) to be extended A set of article and device embodiments of the present invention for providing a selection mechanism is shown in FIG. 5. FIGS. 5A-5D show side views of a series of hex keys of different sizes having proximally extending portions designed for interaction with an adjusting arm and/or adjacent hex key(s) when the hex keys are assembled concentrically together. Although FIG. 5 describes a modified hex key, the same description may be applied analogously and similarly to a modified socket-engaging tool having a socket-engaging portion with a different (non-hexagonal) outer cross-sectional shape. FIG. 5A shows a first modified hex key 1050 according to these embodiments having a hex key portion 1051, attached to a proximally extending leg portion 1053, the leg portion 1053 extending proximally from at or near an outer side edge of the hex key portion 1051. The leg portion 1053 of the first modified hex key 1050 further has two flat or planar structures extending inwardly from the leg portion 1053 that may each be approximately perpendicular to the leg portion 1053. These flat or planar structures may include an inwardly extending ledge portion 1057 and an inwardly extending bumper portion 1059, the ledge portion 1057 being located and positioned closer to the hex key portion 1051 than the bumper portion 1055 (i.e., the ledge portion 1057 is located between the bumper portion 1059 and the hex key portion 1051).

Figure 5B:
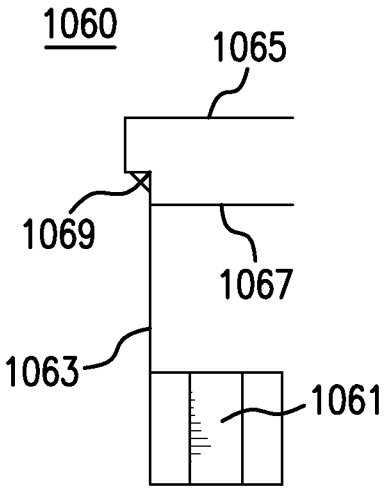
Figure 5C:
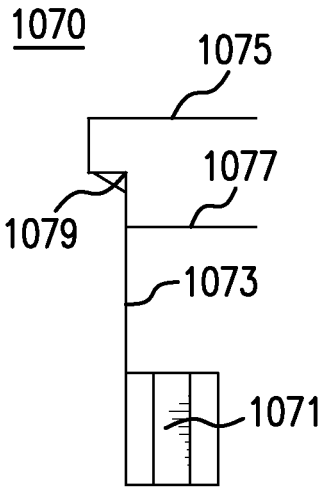
Figure 5D:
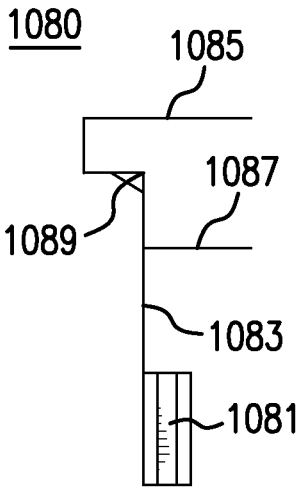

The second, third and fourth modified hex keys 1060, 1070, 1080 in FIGS. 5B-5D may each be similar to the first modified hex key 1050 in FIG. 5A described above. The main difference being that the second, third and fourth modified hex keys 1060, 1070, 1080 in FIGS. 5B-5D have progressively smaller hex key portions 1061, 1071, 1081 and thus have respective corners 1069, 1079, 1089 such that the respective bumper portions 1055, 1065, 1075, 1085 of the second, third and fourth modified hex keys 1050-1080 have about the same size and shape to fit together when assembled with each forming a large enough surface area for the selective engagement by an adjusting arm (see, e.g., FIG. 5H viewed from a proximal perspective at the bumper portions 1055-2005 for a set of six assembled modified hex keys that may each be individually and selectively engaged by an adjusting arm). Another difference between the modified hex keys 1050-1080 in FIGS. 5A-5D is that the positioning of the respective ledge portions 1057, 1067, 1077, 1087 are moved progressively closer to their respective hex key portion 1051, 1061, 1071, 1081 and further away from their respective bumper portions 1055, 1065, 1075, 1085 as these hex key portions 1057, 1067, 1077, 1087 get progressively smaller.

Figure 5E:
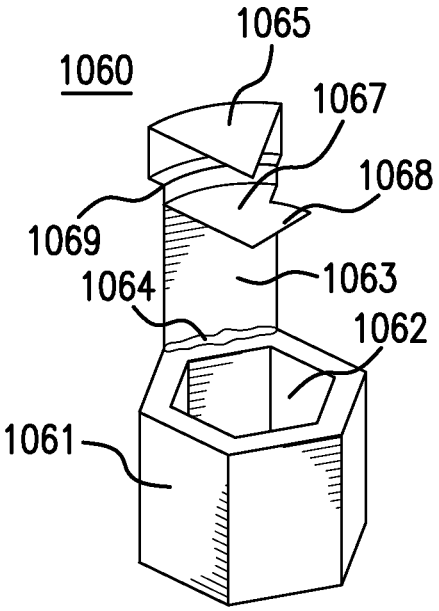
FIG. 5E is a perspective view of the hex key in FIG. 5B having a proximally extending portion for engagement by an adjustment and selection mechanism.

FIG. 5E shows a perspective view of the second modified hex key 1060 in FIG. 5B to show additional features that may be common among the various modified hex keys that may be assembled together. The second modified hex key 1060 may have a hex key portion 1061 with a longitudinal bore 1062 for receiving a next smaller hex key. The hex key portion 1061 is shown attached to the proximally extending leg portion 1063, such as by a weld, etc., 1064. The leg portion 1063 is further shown having an inwardly extending ledge portion 1067 and an inwardly extending bumper portion 1065. To enable the bumper portion 1065 of the second modified hex key 1060 to be the approximately the same size as the bumper portion 1055 of the first modified hex key 1050, the leg portion 1063 of the second modified hex key has a second corner 1069 to accommodate a proximal part of the leg portion 1063 being more outwardly positioned to match the positioning of the leg portion 1053 of the first modified hex key 1050.

Figure 5F:
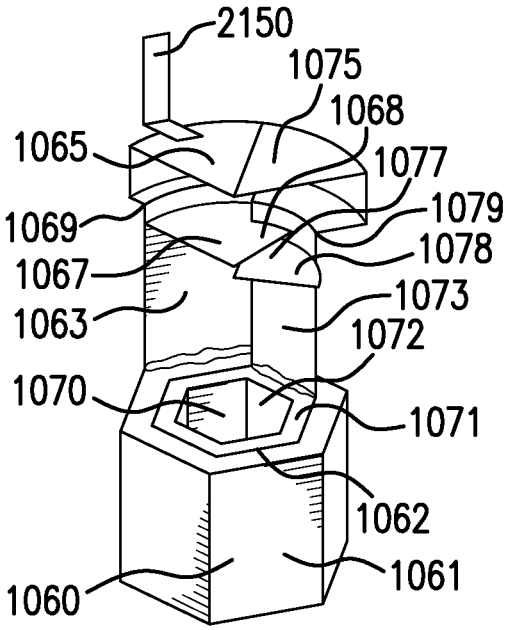
FIG. 5F is a perspective view of the hex keys in FIGS. 5B and 5C assembled together with the hex key in FIG. 5C inserted into the longitudinal bore of the next larger hex key in FIG. 5D and the proximally extending portions of the hex keys positioned adjacent to each other.
Figure 5H:
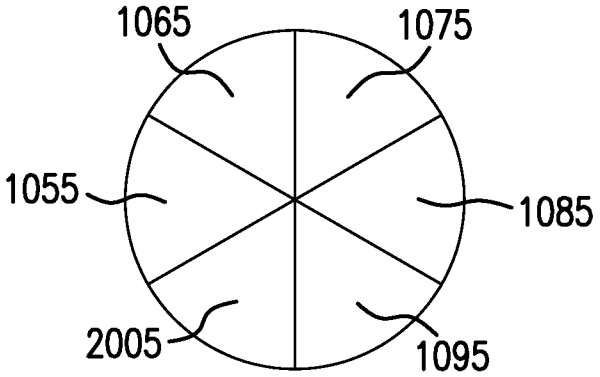
FIG. 5H is a top view of the pie-shaped bumper portions of six hex keys assembled concentrically together.

A side extension 1068 is further shown projecting continuously from one of the side edges of the ledge portion 1067 for engagement with an adjacent and contiguous (i.e., next smaller) modified hex key. FIG. 5F provides a perspective view of the second and third modified hex keys 1060, 1070 assembled adjacently and contiguously together in a concentric arrangement (i.e., with the third modified hex key 1070 inserted into the next larger second modified hex key 1060). The third modified hex key 1070 is inserted into the second modified hex key 1060 such that their respective proximally extending leg portions 1063, 1073 are also adjacent and juxtaposed (i.e., angularly positioned at 60° relative to each other).

As mentioned above, the positioning of the respective ledge portions 1057, 1067, 1077, 1087 of the modified hex keys 1050, 1060, 1070, 1080 are moved progressively closer to their respective hex key portion 1051, 1061, 1071, 1081 as the hex key portions 1051, 1061, 1071, 1081 get progressively smaller. Thus, the side extension of the ledge portion of a modified hex key will be positioned proximal to the ledge portion of the next smaller hex key positioned adjacent to it. As a result, the distal extension of the modified hex key (e.g., by an adjusting arm) will further cause the next smaller modified hex key to be co-extended by engagement of the side extension with the ledge portion of the next smaller modified hex key. As shown for example in FIG. 5F, side extension 1068 of ledge portion 1067 of the second modified hex key 1060 is positioned proximally to the ledge portion 1077 of the third modified hex key 1070 such that distal movement of the second modified hex key 1060 will also cause distal movement of the third modified hex key 1070 by the side extension 1068 of the second modified hex key 1060 engaging the ledge portion 1077 of the third modified hex key 1070. Although not shown in FIG. 5F, additional modified hex key(s) may also be inserted inside bore 1072 of the third modified hex key 1070, and the ledge portion of the next smaller modified hex key (e.g., ledge portion 1087 of fourth modified hex key 1080) may be engaged by side extension 1078 of ledge portion 1077 of the third modified hex key 1070.

As mentioned above, an adjusting arm may selectively engage a proximal surface of the bumper portion of one of the modified hex keys to force distal movement of the modified hex key by the distal movement of the adjusting arm. As shown in FIG. 5F, a distal end of an adjusting arm 2150 may selectively engage and/or contact a proximal face of the bumper portion 1065 of the second modified hex key 1060 to cause distal movement of the second modified hex key 1060 and thus third modified hex key 1070 by the engagement and/or contact between the side extension 1068 of the second modified hex key 1060 with the ledge portion 1077 of the third modified hex key 1070. Although not shown in FIG. 5F, additional hex key(s) may also be present inside bore 1072 of the third hex key 1070 and also moved distally by the force exerted by the adjusting arm 2150 due to the further engagement(s) between the side extension(s) (including side extension 1078) and the ledge portion(s) of these additional modified hex key(s).

Figure 5G:
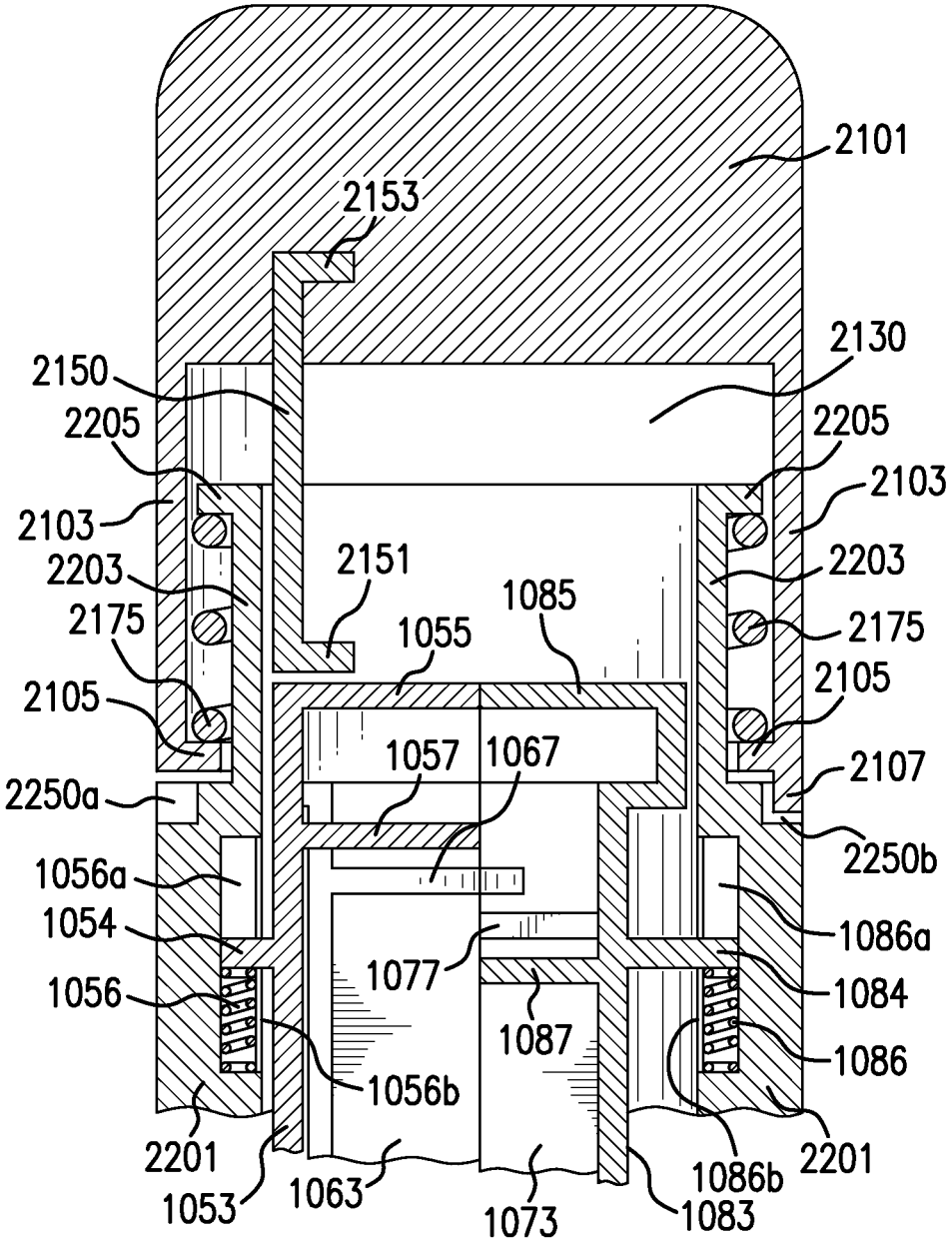
FIG. 5G is a cross-sectional view of a device embodiment of the present invention having at least four concentric hex keys with adjacent proximally extending portions for engagement by an adjustment and selection mechanism, the selective engagement of the hex keys being determined by the selective rotation and release of a top rotating portion of the device physically coupled to an adjusting arm that engages the respective proximally extending portion of a hex key to cause extension of one or more of the hex keys.

FIG. 5G provides a cross-sectional view of an example device embodiment of the present invention utilizing modified hex keys 1050, 1060, 1070, 1080 (similar to the modified hex keys in FIGS. 5A-5D) that are assembled together in a concentric arrangement. Only four modified hex keys 1050-1080 are visible in the embodiment in FIG. 5G, but as many as six modified hex keys may be present and concentrically arranged together. The device embodiment is shown having a rotating handle or knob portion 2101 and a main body portion 2201 coupled together by a spring-loaded engagement comprising a distally extending neck 2103 of the rotating portion 2101, a proximally extending neck 2203 of the main body portion 2201, and an engagement spring 2175 positioned between an inwardly projecting flange 2105 of the proximally extending neck 2203 of the main body portion 2201 and an outwardly projecting flange 2205 of the distally extending neck 2103 of the rotating knob portion 2101 of the device. Similarly to the embodiments in FIGS. 4E and 4F, the main body portion 2201 of the device may also be described as a holder or body.

It is important to note, however, that other arrangements are possible for the spring-loaded coupling between the rotating knob portion 2101 and the main body portion 2201 of a device to provide a hex key selection mechanism. For example, the relative inward-outward orientation of the distally extending neck 2103 of the rotating portion 2101 of the device and the proximally extending neck 2203 of the main body portion 2201 may be reversed, such that the proximally extending neck portion 2203 of the main body portion 2201 is on the outside. With such an arrangement, the spring would be positioned between an inwardly projecting flange of the proximally extending neck of the main body portion and an outwardly projecting flange of the proximally extending neck of the rotating knob portion.

As shown for example in FIG. 5G, each of the modified hex keys may be positioned inside a cavity 2130 of the main body portion 2201. Each of the modified hex keys may also have a radially outward extending guide arm having an outer portion that may be positioned within the interior of a corresponding longitudinally oriented side channel in the side of the main body portion. For example, proximally extending leg portion 1053 is shown having a radially outward extending guide arm 1054 that extends into a longitudinal channel 1056*a*. The outer portion of the guide arm 1054 may slide or move proximally or distally along and within the side channel 1056*a* in response to the proximally directing force of a respective biasing spring 1056 inside the channel 1056*a* and/or the distally directing force of the adjusting arm 2150 due to forces ultimately generated by the engagement spring 2175 when the rotating knob portion 2101 is released from a retracted position. Another proximally extending leg portion 1083 of another modified hex key is also shown having a radially outward extending guide arm 1084 that extends into another longitudinally oriented side channel 1086*a*. The outer portion of the guide arm 1084 may slide or move proximally or distally along and within the side channel 1086*a* in response to the proximally directing force of a respective biasing spring 1086 inside the channel 1086*a* and/or the distally directing force of the adjusting arm 2150 due to forces ultimately generated by the engagement spring 2175 when the rotating knob portion 2101 is released.

Although only two guide arms are shown in cross-section in FIG. 5G, each of the concentrically arranged modified hex keys (as many as six) would have their own guide arm according to this embodiment to engage a dedicated biasing spring inside a respective side channel, such that the retraction/extension of each modified hex key may be individually controlled. Each of the guide arms may have an enlarged outer portion that fits inside its respective side channel with a narrower connector portion that fits inside a respective slot opening between the side channel and the cavity of the main body portion 2201. The slot may be narrower than the side channel such that the enlarged outer portion of the respective guide arm may be kept within the side channel as it moves between a retracted and an extended state.

Even without the enlarged outer portion and narrower slot, each of the guide arms may also function to physically stabilize one or more of the modified hex key(s) against external forces during use by bracing and supporting their fixed positioning and placement of the modified hex key(s) against the side(s) of the main body portion and the respective side channel. It is also important to note that the positioning of the guide arms may vary along the proximal-distal length of the leg portion of the respective modified hex key, and the positioning of the side channel may vary accordingly. The relative positioning of the guide arms of the modified hex keys may also vary in relative terms with pairs of guide arms and side channels for different modified hex keys located at different positions along the length of the main body portion of the device. According to some embodiments, one or more of the guide arm(s) may even be attached to, and outwardly extended from, a hex key portion of a respective modified hex key.

When the rotating knob portion 2101 is manually pulled back or retracted, the engagement spring 2175 is compressed, and the adjusting arm 2150 is retracted and moved proximally away from the bumper portions of the modified hex keys. As a result, all of the modified hex keys become retracted to a default position by their respective biasing springs due to the absence of force being exerted on them by the adjusting arm 2150. For example, the guide arm 1054 (attached to the leg portion 1053 of one of the modified hex keys), is caused to move proximally (if starting from an extended state or position) by its respective biasing spring 1056 positioned in the channel 1056*a* between the guide arm 1054 and the distal end of the channel 1056*a*, and the guide arm 1084 (attached to the leg portion 1083 of another modified hex key), is also caused to move proximally (if starting from an extended state or position) by its respective biasing spring 1086 positioned in the channel 1086*a* between the guide arm 1084 and the distal end of the channel 1086*a*, due to retraction and/or disengagement of the adjusting arm 2150.

With the rotating knob portion 2101 of the device pulled back to a retracted position, the rotating knob portion 2101 of the device may be rotated or turned to a new selected position to change which modified hex key(s) is/are directly or indirectly engaged by the adjusting arm 2150 to cause their distal extension. As explained above and as further shown in FIG. 5G, the ledge portions 1057, 1067, 1077, 1087 of the respective modified hex keys are progressively positioned more distally such that distal movement of a modified hex key will also cause simultaneous distal movement of the smaller modified hex key(s) due to contact engagement between the side extension(s) and the ledge portion(s) of the smaller hex key(s).

Thus, when a user selects a desired hex key size for a particular use and causes it to become extended from the device, the bumper portion for that modified hex key is engaged by the adjusting arm due to the user first turning the rotating knob portion 2101 (while the rotating knob portion 2101 is manually pulled back and retracted by the user) until the adjusting arm becomes aligned with the bumper portion of the desired modified hex key. External markings may assist the user in properly positioning the rotating knob portion for selective extension of a modified hex key for use. The user may then release the rotating knob portion 2101 of the device, which will then cause the rotating portion 2101 to move distally (due to forces exerted by the engagement spring 2175) to a distal default position, and the distal end 2151 of the adjusting arm 2150 will move distally as well into engagement and/or contact with the bumper portion of the desired and selected modified hex key to cause its distal extension (perhaps along with the smaller hex key(s) due to contact engagement of the side extension(s)). In the distal default position, a distal portion of the distally extending neck of the rotating knob portion is juxtaposed with, and positioned closely adjacent to, a distal portion of the proximally extending neck of the main body portion, regardless of which modified hex key is engaged or contacted by the adjusting arm. The adjusting arm 2150 moves with the rotating knob portion 2101 during movement (e.g., rotation, retraction, released extension, etc.) of the rotating knob portion 2101 due to a fixed attachment and connection between the rotating portion 2101 and a more proximal portion (e.g., proximal end 2153) of the adjusting arm 2150.

FIG. 5G depicts an extended state for the modified hex keys due to contact engagement between the distal end 2151 of the adjusting arm 2150 and the proximal face of the bumper portion 1055 of a first (largest) modified hex key (physical contact is present between these opposing surfaces in FIG. 5G even though a slight gap may appear between them in this figure). Thus, the biasing spring 1056 becomes compressed by the corresponding modified hex key being moved distally by the force generated from the engagement spring 2175 via the adjusting arm 2150 contacting the bumper portion 2155 of the largest modified hex key. As a result, the second, third and fourth modified hex keys may also be extended distally and their respective biasing springs are also compressed due to their overlapping side extensions and ledge portions, which transmit the force from the adjusting arm 2150 to the smaller modified hex keys in a descending order as described above.

From the extended state in FIG. 5G, the rotating knob portion 2101 may be pulled back to compress engagement spring 2175 and disengage adjusting arm 2150 from the bumper portion 1055 of one of the largest modified hex keys. As a result, each of the modified hex keys will become retracted by the combined action of their dedicated biasing springs in their respective side channels. With rotating knob portion 2101 retracted, the rotating knob portion 2101 may also be rotated or turned to reposition the adjusting arm 2150 into alignment with the bumper portion of another modified hex key of choice (e.g., a smaller size). Once aligned, the rotating knob portion 2101 may then be released to cause the distal end 2151 of the adjusting arm 2150 to contact and engage the bumper portion of the selected modified hex key to cause its distal extension by forces generated by the engagement spring 2175 that are delivered and transmitted via the adjusting arm 2150 to the modified hex key of choice. Although the adjusting arm 2150 is depicted in FIGS. 5F and 5G as having a simple linear shape, an adjusting arm of the present invention may instead have a variety of different shapes while still carrying out the function of engaging a selected bumper portion of a modified hex key. The simple design of the adjusting arm 21050 in these figures is used to covey the concept of this feature.

A plurality of spaced-apart notches may also be present around the outer side periphery of either the main body portion or the rotating knob portion near where those two portions of the device meet. Such notches may be engaged by a corresponding one or more tab(s) extending from the opposing portion of the other portion of the device and oriented toward those notches for their engagement together. For example, a plurality of spaced-apart notches 2250*a*, 2250*b* are depicted in FIG. 5G in a proximal portion of the main body portion 2201 near the distal-most end of the proximally extending neck 2203 of the main body portion 2201 that may each be engaged by an opposing tab 2107 on the distal end of the distally extending neck 2103 of the of the rotating knob portion 2101 of the device. Even though only two notches 2250*a*, 2250*b* are shown, there may be more notches, such as a number of notches may be equal (or more than equal) to the number of modified hex keys that may be individually selected. Engagement and insertion of the tab 2107 with one of the notches 2250 may thus correspond to a particular modified hex key and alignment of the adjusting arm 2150 with the bumper portion for that modified hex key of choice, which may facilitate such alignment for a user in combination with various markings. Thus, to change the selection of which modified hex key size to extend, the rotating knob portion 2101 may be retracted and rotated until the tab 2107 is aligned with the notch corresponding to that modified hex key, and the rotating portion 2101 may be released such that the adjusting arm engages the bumper portion for that modified hex key accordingly.

According to another broad aspect of the present invention, methods are provided for the assembly and operation of a device embodiment of the present invention as described above. According to some embodiments, the socket-engaging tools may be assembled together in a concentric arrangement and placed inside a base or holder, or one or more of the socket-engaging tools may be inserted concentrically into an outermost concentric socket-engaging tool inside a base or holder. Various biasing springs may also be assembled with the other parts of a device. Operation of a device of the present invention may be carried out by applying an external force to the distal end(s) of one or more of the socket-engaging tool(s), and/or by actuating proximal or distal movement of one or more of the socket-engaging tool(s) by movement of an adjusting mechanism(s), such as by movement of a threaded shaft or extension/retraction of an adjusting arm attached to a rotating portion of the device.

While the present invention has been disclosed with reference to certain embodiments, it will be apparent that modifications and variations are possible without departing from the spirit and scope of the invention as defined in the appended claims. Furthermore, it should be appreciated that all examples in the present disclosure, while illustrating embodiments of the invention, are provided as non-limiting examples and are, therefore, not to be taken as limiting the various aspects so illustrated. The present invention is intended to have the full scope defined by the language of the following claims, and equivalents thereof. Accordingly, the drawings and detailed description are to be regarded as illustrative and not as restrictive.

What is claimed is:

1. A socket-engaging device comprising:

a plurality of socket-engaging tools, each of the socket-engaging tools having a proximal end and a distal end, the plurality of socket-engaging tools being assembled together in a concentric arrangement, wherein each of the socket-engaging tools has a constant outer cross-sectional size and shape along most or all of its length, the plurality of socket-engaging tools comprising an outermost socket-engaging tool and one or more inner socket-engaging tools, the one or more inner socket-engaging tools comprising an innermost first socket-engaging tool;

a holder, the holder having a proximal end and a distal end, wherein the holder at least partially surrounds the plurality of socket-engaging tools, and wherein the outermost socket-engaging tool is fixedly attached to the holder, the distal end of the outermost socket-engaging tool projecting outwardly from the distal end of the holder;

at least one biasing spring, the at least one biasing spring comprising a first biasing spring, wherein the first biasing spring is positioned within a cavity of the holder between a proximal end piece of the first socket-engaging tool and the proximal end of a next larger socket-engaging tool, the first socket-engaging tool being biased to a more proximal position by the first biasing spring; and a threaded adjusting shaft, the threaded adjusting shaft being engaged with a threaded bore of the holder spanning from the proximal end of the holder to the cavity inside the holder, wherein the threaded adjusting shaft has a distal contacting portion that engages the proximal end piece of the first socket-engaging tool;

wherein the one or more inner socket-engaging tools are positioned concentrically within a longitudinal bore of the outermost socket-engaging tool, each of the one or more inner socket-engaging tools being able to move independently along its longitudinal axis relative to the outermost socket-engaging tool, wherein the engagement between the threaded adjusting shaft and the threaded bore of the holder causes proximal or distal movement of the threaded adjusting shaft depending on the direction of rotation of the threaded adjusting shaft relative to the holder, and wherein the proximal biasing of the first socket-engaging tool by the first biasing spring is opposed by the distal contacting portion of the threaded adjusting shaft when the distal contacting portion is engaged with the proximal end piece of the first socket-engaging tool.

2. The device of claim 1, wherein the plurality of socket-engaging tools comprises a plurality of hex keys.

3. The device of claim 1, wherein distal movement of the threaded adjusting shaft causes at least the first socket-engaging tool to extend distally from a retracted position, and wherein proximal movement of the threaded adjusting shaft causes at least the first socket-engaging tool to retract proximally from an extended position.

4. The device of claim 1, wherein the one or more inner socket-engaging tools further comprises a second socket-engaging tool, and wherein the second socket-engaging tool is the next larger socket-engaging tool.

5. The device of claim 4, wherein the at least one biasing spring comprises at least two biasing springs, the at least two biasing springs comprising a second biasing spring, the second biasing spring being positioned within the cavity between the proximal end of a second socket-engaging tool and a proximal face of the cavity inside the holder, and wherein the second biasing spring is attached at one end to a proximal end piece of the second socket-engaging tool and attached at the other end to the proximal face of the cavity inside the holder, the second biasing spring resisting distal movement of the second socket-engaging tool.

6. The device of claim 5, wherein the first biasing spring has a greater tension strength than the second biasing spring.

7. The device of claim 5, wherein the at least two biasing springs comprise at least three biasing springs, the at least three biasing springs comprising a third biasing spring, the third biasing spring being positioned within the cavity between the proximal end of a third socket-engaging tool and a proximal face of the cavity inside the holder, and wherein the third biasing spring is attached at one end to a proximal end piece of the third socket-engaging tool and attached at the other end to the proximal face of the cavity inside the holder, the third biasing spring resisting distal movement of the third socket-engaging tool.

8. The device of claim 7, wherein the second biasing spring has a greater tension strength than the third biasing spring.

9. The device of claim 1, wherein the threaded adjusting shaft further comprises a knob fixedly attached to the proximal end of the threaded adjusting shaft.

10. The device of claim 1, wherein the at least one biasing spring comprises at least two biasing springs, the at least two biasing springs comprising a second biasing spring, the second biasing spring being positioned within the cavity between the proximal end piece of a second socket-engaging tool and the proximal end of a third socket-engaging tool.

11. The device of claim 10, wherein the second biasing spring resists distal movement of the second socket-engaging tool from a more retracted position.

12. The device of claim 11, wherein the first biasing spring has a greater tension strength than the second biasing spring.

13. The device of claim 1, further comprising:

a rotating knob portion, the rotating knob portion having a threaded receiving bore, wherein the rotating knob portion is rotatably coupled to the handle, the rotating knob portion being positioned on the proximal side of the holder and at a fixed distance relative to the proximal end of the holder, wherein the threaded receiving bore of the rotating knob portion is aligned with the threaded bore of the handle for the threaded receiving bore to receive at least a proximal portion of the threaded adjusting shaft, and wherein rotation of the rotating knob portion relative to the holder causes the threaded adjusting shaft to move in either the distal or proximal direction depending on the direction of rotation of the rotating knob portion.

14. The device of claim 13, wherein the rotating knob portion is coupled to the holder by at least one side bracket.

15. A socket-engaging device comprising:

a plurality of modified hex keys, each of the modified hex keys comprising:

a hex key portion, the hex key portion having a constant outer cross-sectional size and shape from a proximal end to a distal end of the hex key portion;

a leg portion, the leg portion extending proximally from the hex key portion at or near an outer side edge of the hex key portion;

a bumper portion, the bumper portion having a planar shape and extending inwardly from the leg portion at or near the proximal end of the leg portion; and a ledge portion, the ledge portion having a planar shape and extending inwardly from the leg portion, the ledge portion being positioned between the bumper portion and the proximal end of the hex key portion;

a main body portion, the main body portion at least partially surrounding the plurality of modified hex keys, the plurality of modified hex keys being positioned within a cavity inside main body portion; and a rotating knob portion, the rotating knob portion being rotatably coupled to the main body portion by a spring loaded coupling that resists retraction of the rotating knob portion away from the main body portion, wherein the plurality of modified hex keys comprises a first modified hex key and a second modified hex key, the hex key portion of the second modified hex key being larger than the hex key portion of the first modified hex key, wherein the second modified hex key has a bore from the proximal end to the distal end of the hex key portion of the second modified hex key, and wherein the hex key portion of the first modified hex key is positioned concentrically within the bore of the hex key portion of the second modified hex key.

16. The device of claim 15, further comprising:

an adjusting arm, the proximal end of the adjusting arm being attached to the rotating knob portion, wherein the adjusting arm extends distally from the rotating knob portion into the cavity of the main body portion.

17. The device of claim 16, wherein the distal end of the adjusting arm contacts a proximal face of a bumper portion of one of the modified hex keys when the rotating knob portion is in the distal default position to cause the respective modified hex key to become extended distally.

18. The device of claim 17, wherein each of the modified hex keys further comprises a guide arm projecting outwardly from the respective modified hex key, the outer portion of the guide arm extending into a respective channel in a side of the main body portion, the respective modified hex key being biased to a more proximal position by a guide spring present in the respective channel between the guide arm and the distal end of the respective channel.

19. The device of claim 17, wherein the modified hex key contacted by the adjusting arm may be changed by retraction and rotation of the rotating knob portion of the device followed by release of the rotating knob portion to the distal default position.

20. The device of claim 15, wherein the ledge portion of the second modified hex key further comprises a side extension, the side extension of the second modified hex key being positioned on the proximal side of the ledge portion of the first modified hex key with the ledge portion of the first modified hex key being positioned closer to the hex key portions of the first and second modified hex keys than the ledge portion of the second modified hex key, and wherein distal movement of the second modified hex key causes distal movement of the first modified hex key due to the side extension of the ledge portion of the second modified hex key being positioned proximally to the ledge portion of the first modified hex key.

* * * * *